United States Patent [19]

Smith et al.

[11] Patent Number: 4,464,866

[45] Date of Patent: Aug. 14, 1984

[54] CONTROL SYSTEM FOR FINISH GRINDING METHODS AND APPARATUS

[75] Inventors: Roderick L. Smith, Rockford, Ill.; Norbert C. Kolell, Fond du Lac, Wis.

[73] Assignee: Energy-Adaptive Grinding, Inc., Rockford, Ill.

[21] Appl. No.: 355,304

[22] Filed: Mar. 5, 1982

[51] Int. Cl.[3] ..... B24B 49/10

[52] U.S. Cl. ..... 51/165.87; 51/325; 318/571

[58] Field of Search ..... 51/165.19, 165.77, 165.87, 51/165.88, 325; 318/162, 571; 364/474

[56] References Cited

U.S. PATENT DOCUMENTS

| | | | |
|---|---|---|---|
| 1,666,237 | 4/1928 | Fuller | 51/165.87 |
| 3,736,704 | 6/1973 | Robillard | 51/165.87 |
| 3,938,492 | 2/1976 | Mercer | 51/165.87 |
| 4,118,900 | 10/1978 | Moritomo | 51/165.87 |

*Primary Examiner*—Harold D. Whitehead

*Attorney, Agent, or Firm*—Leydig, Voit, Osann, Mayer & Holt, Ltd.

[57] ABSTRACT

A system for finish grinding a workpiece monitors the actual radius of the workpiece as the finish grinding progresses; feeds the grinding wheel into the workpiece at a feed rate which decreases, preferably at an exponential rate, as a desired final radius of the workpiece is approached; and terminates the feeding of the grinding wheel at the desired final radius of the workpiece. In a preferred embodiment, the grinding wheel is trued, simultaneously with the finish grinding, by feeding a truing element into the grinding wheel at a rate that varies as a function of the decreasing rate at which the grinding wheel is fed into the workpiece. The truing element is preferably advanced toward the grinding wheel at a rate which has (1) a first component corresponding to the rate at which it is desired to remove material from the grinding wheel at the truing interface and (2) a second component corresponding to the wear rate of the grinding wheel due to grinding, the second component varying as a function of the rate at which the grinding wheel is fed into the workpiece. The grinding wheel is preferably advanced toward the workpiece at a rate which has (1) a first component corresponding to the decreasing feed rate at which the wheel is fed into the workpiece and (2) a second component corresponding the rate at which material is removed from the grinding wheel at the truing interface. The wear rate of the grinding wheel due to grinding is determined from a power function relationship between the wheel wear rate and the wheel feed rate for a particular grinding operation.

28 Claims, 15 Drawing Figures

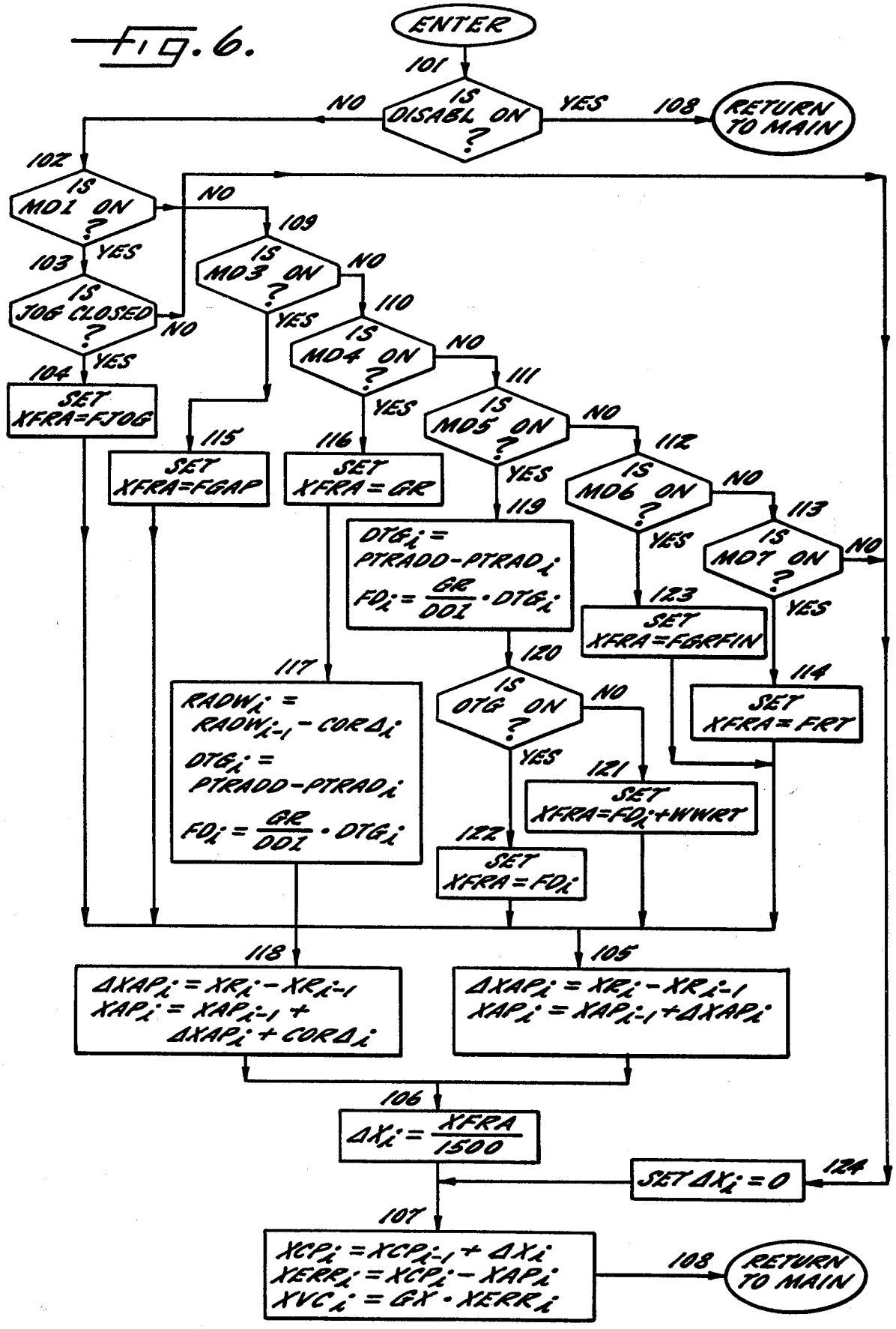
Fig. 6.
ENTER
101
IS DISABL ON ?
NO
YES
108
RETURN TO MAIN
102
IS MD1 ON ?
NO
YES
103
IS JOG CLOSED ?
NO
YES
104
SET XFRA=FJOG
109
IS MD3 ON ?
NO
YES
110
IS MD4 ON ?
NO
YES
111
IS MD5 ON ?
NO
YES
112
IS MD6 ON ?
NO
YES
113
IS MDT ON ?
NO
YES
115
SET XFRA=FGAP
116
SET XFRA=GR
119
DTG_i = PTRADD-PTRAD_i
FD_i = GR/DDI · DTG_i
123
SET XFRA=FGRFIN
114
SET XFRA=FRT
117
RADW_i = RADW_i-1 - COR Δ_i
DTG_i = PTRADD-PTRAD_i
FD_i = GR/DDI · DTG_i
120
IS DTG ON ?
NO
YES
121
SET XFRA=FD_i+WWRT
122
SET XFRA=FD_i
118
ΔXAP_i = XR_i - XR_i-1
XAP_i = XAP_i-1 + ΔXAP_i + COR Δ_i
105
ΔXAP_i = XR_i - XR_i-1
XAP_i = XAP_i-1 + ΔXAP_i
106
ΔX_i = XFRA/1500
124
SET ΔX_i = 0
107
XCP_i = XCP_i-1 + ΔX_i
XERR_i = XCP_i - XAP_i
XVC_i = GX · XERR_i
108
RETURN TO MAIN

CONTROL SYSTEM FOR FINISH GRINDING METHODS AND APPARATUS

FIELD OF INVENTION AND OBJECTS

The present invention relates to grinding systems for grinding a wide variety of different kinds of workpieces with rotationally driven grinding wheels which wear down during grinding. This invention specifically relates to methods and apparatus for controlling the finish grinding phase of such grinding operations to improve grinding accuracy, efficiency and/or reliability, and/or to reduce grinding time or cost.

The most complex phase of many grinding operations is the "finish grinding" phase when the workpiece is approaching its final ground dimension. Not only must the grinding operation be terminated at precisely the desired final workpiece dimension, but also the workpiece must have exactly the desired final shape and surface finish, and all these objectives must be met without increasing the temperature of the workpiece so much as to change its metallurgical characteristics. In order to achieve all these desired characteristics in the end product, the shape of the grinding wheel must be controlled because it is the shape of the wheel that determines the final shape of the product; the surface condition of the grinding wheel must be controlled because it is this surface condition that is the primary factor controlling the surface finish of the product; and the feed rate of the grinding wheel must be controlled because it this feed rate that determines the effect of the finish grinding on the overall grinding time as well as the precision with which the grinding wheel can be stopped at precisely the desired final dimension of the product. Control of the wheel feed rate is complicated by the need to stop the wheel at the desired final workpiece dimension, by the wear of the grinding wheel during finish grinding, and by the fact that the workpiece "springs back" as the pressure exerted by the grinding wheel is reduced, thereby reducing deflection of the workpiece.

It is a primary object of the present invention to provide an improved grinding system which controls finish grinding in a manner that accurately, consistently and reliably produces the desired ground part time after time, thereby minimizing the number of workpieces that must be rejected even over long production runs involving hundreds or thousands of parts which must be held within close tolerances. In this connection, a related object of the invention is to provide such an improved grinding system which is capable of achieving the desired dimension, shape, and surface finish of the end product within close tolerances.

Another object of the invention is to provide a grinding system which significantly enhances the speed, efficiency and accuracy of finish grinding, thereby improving both the economy and the productivity of the grinding system.

A more specific object of this invention is to provide an improved grinding system which includes a finish grinding stage in which the workpiece is rapidly and smoothly ground down to precisely the desired final dimension, shape and surface finish, so that the overall grinding time is not unduly increased by the finish grinding stage.

A further specific object of the invention is to provide an improved grinding system which decelerates the feed rate of the grinding wheel during finish grinding while at the same time continuously truing the wheel at a rate which is known at all times during the deceleration, thereby permitting the wheel feed rate to be accurately controlled. A related object is to provide such an improved finish grinding system which advances the grinding wheel at a relatively rapid rate during the initial portion of finish grinding and then rapidly decelerates the feed rate of the wheel during the latter portion of finish grinding, and yet maintaining accurate control of both the wheel feed rate and the simultaneous truing throughout these rapid changes.

Another specific object of the invention is to provide such an improved finish grinding system which is also capable of controllably changing the condition of the wheel surface while the feed rate of the wheel is being decelerated, and still maintaining accurate control of the grinding of the workpiece as the feed rate is decelerated with a simultaneously changing wheel surface condition.

These and other objects and advangtages will become apparent as the following detailed description proceeds, taken in conjunction with the accompanying drawings.

IDENTIFICATION OF DRAWING FIGURES

Figure 1A:
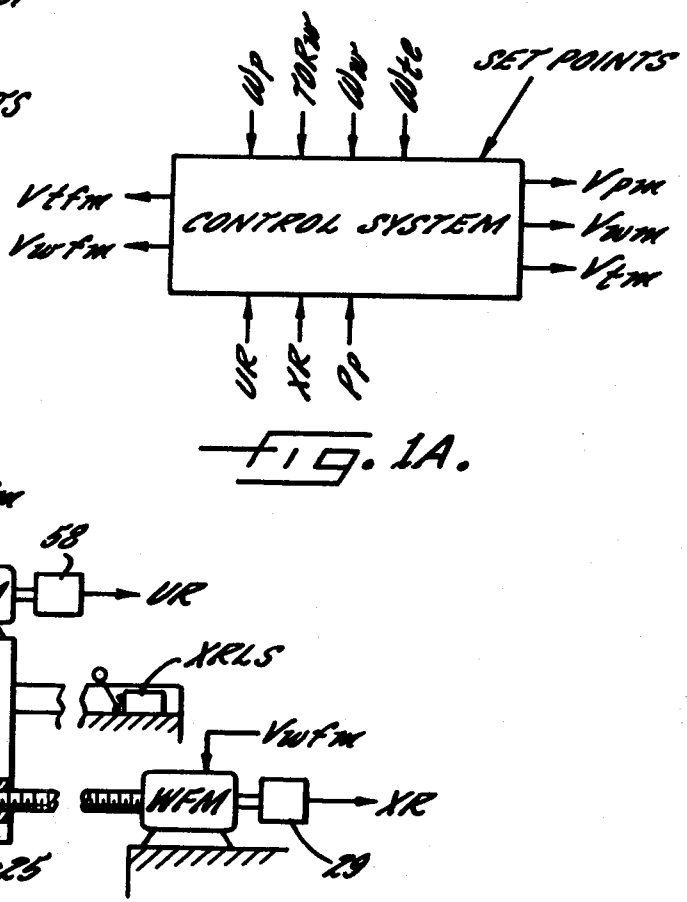
FIG. 1A is a generalized representation of a control system to be associated with the apparatus of FIG. 1 in the practice of the present invention according to any of several embodiments.
Figure 1:
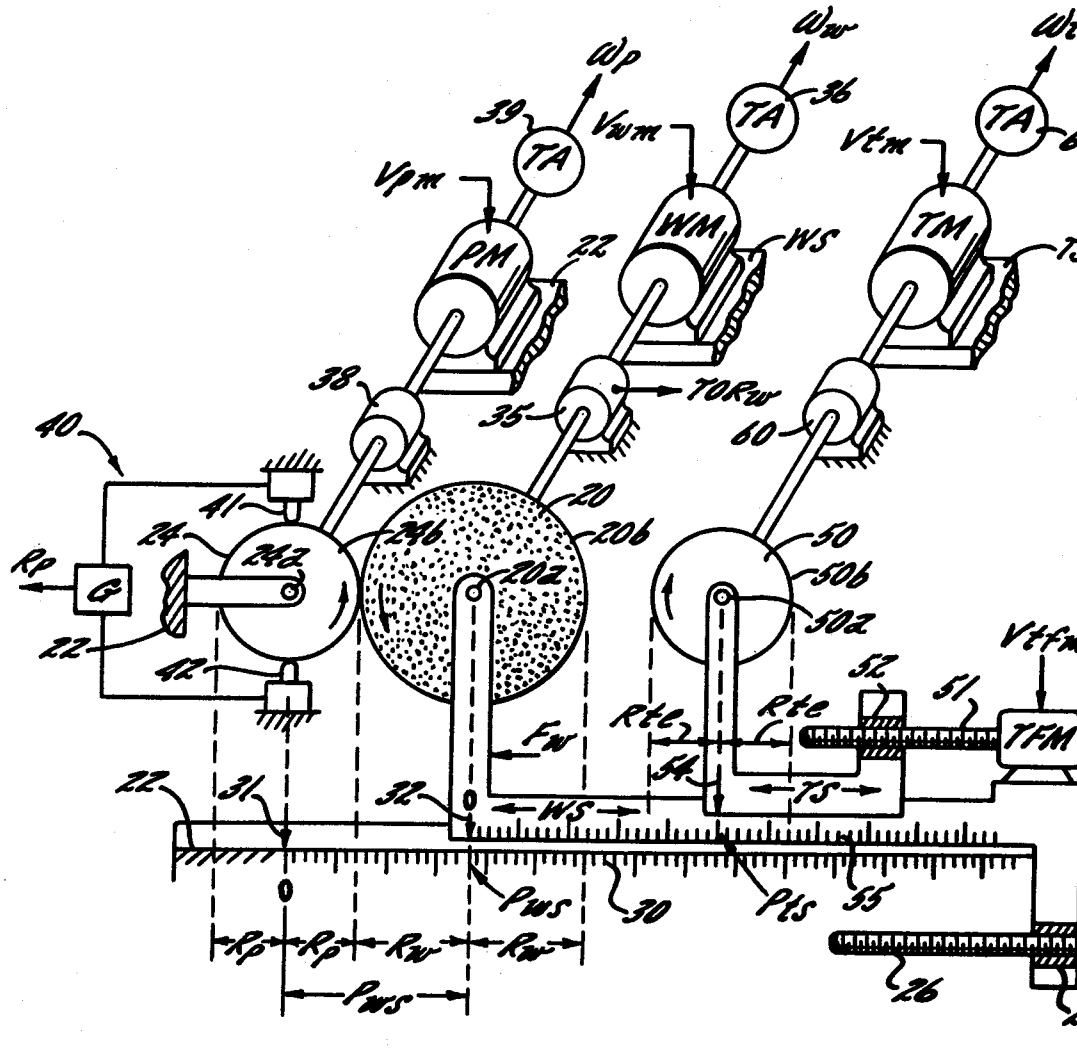
FIG. 1 is a diagrammatic illustration of an exemplary grinding machine with rotational and feed drives for the various relatively movable components, and with sensors for signaling the values of different physical parameters such as speeds, feed rates, positions and torques.
Figure 2:
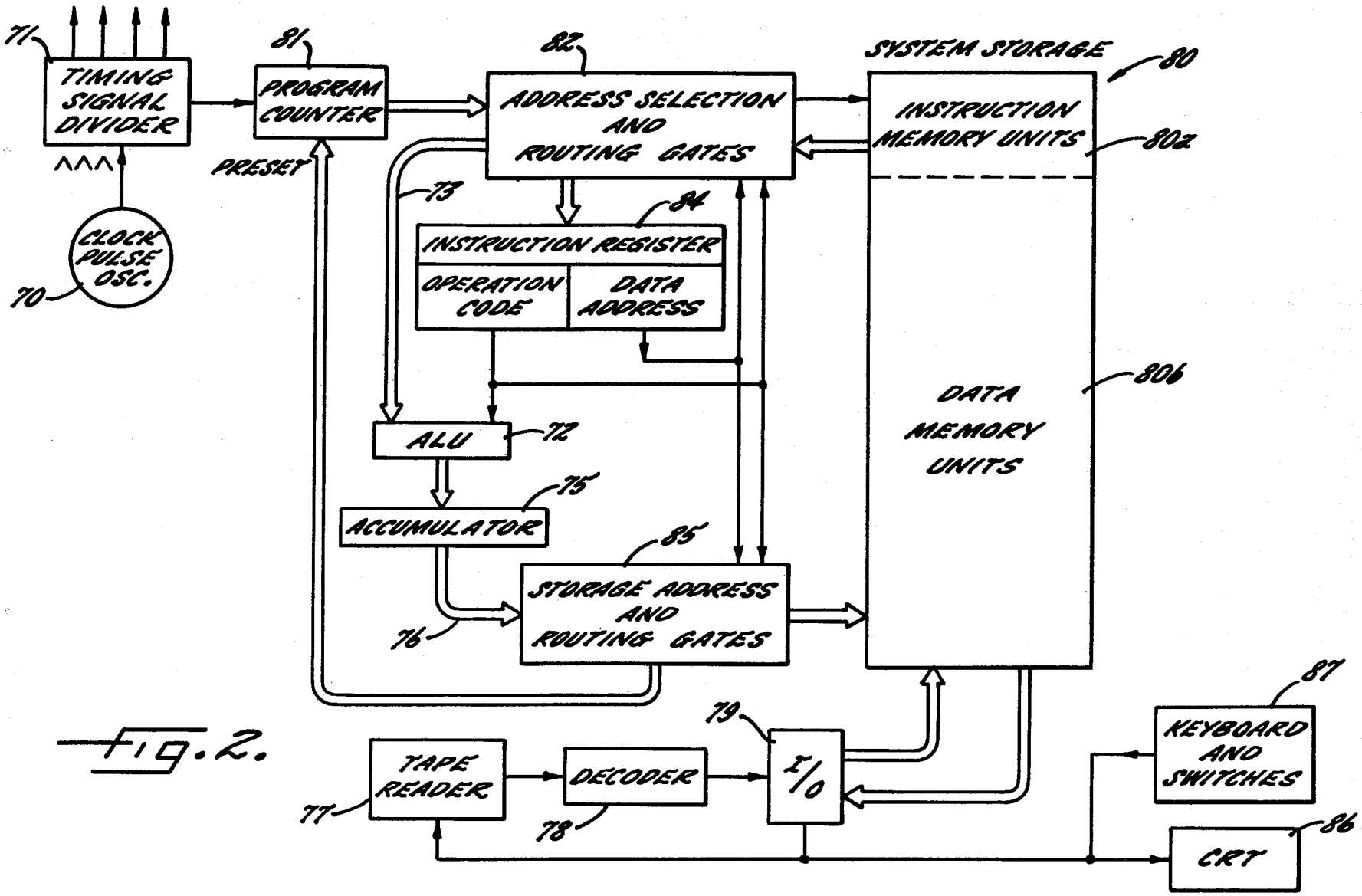
FIG. 2 is a block diagram of one suitable form of digital minicomputer with associated memory or storage, for use in controlling the grinding machine of FIG. 1.
Figure 3:
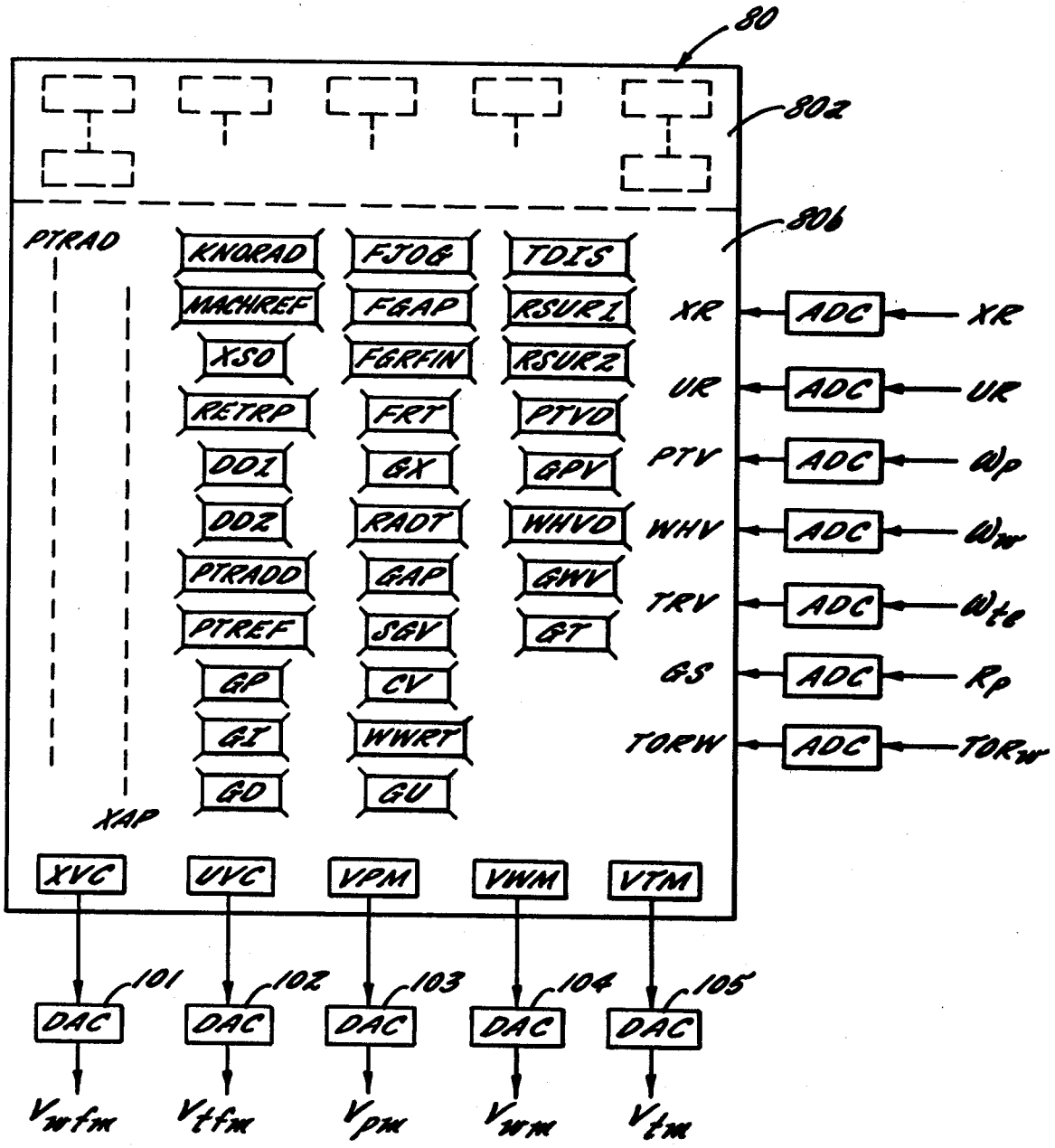
FIG. 3 is a block representation of the signal storage units or memory for the minicomputer of FIG. 2, when used to control the grinding machine of FIG. 1 in accordance with one embodiment of the invention.
Figure 4:
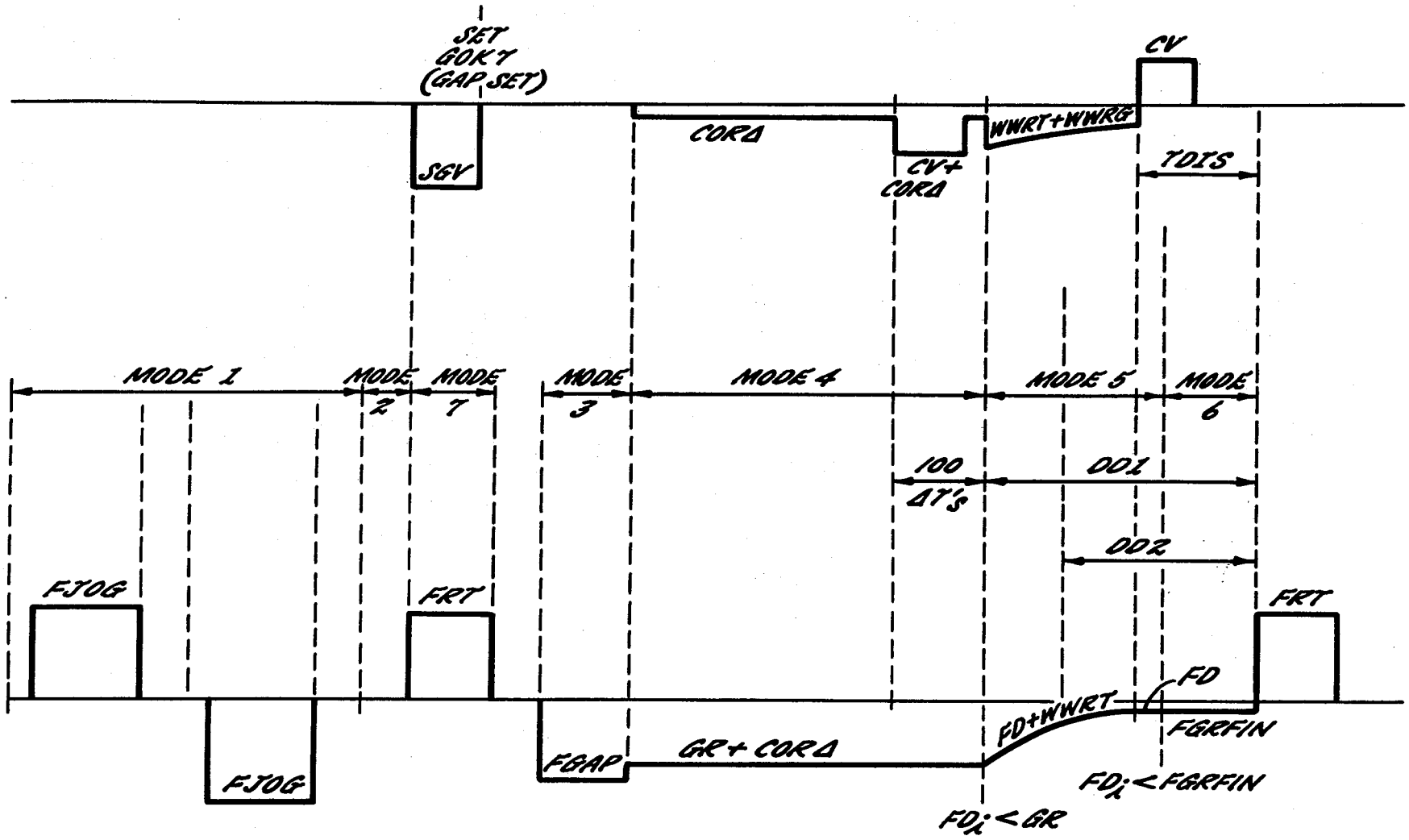
FIG. 4 is a timing diagram illustrating the various modes of operation involved in the grinding of a single workpiece in accordance with one embodiment of the invention, using the grinding machine of FIG. 1 as controlled by the minicomputer of FIG. 2.
Figure 5A:
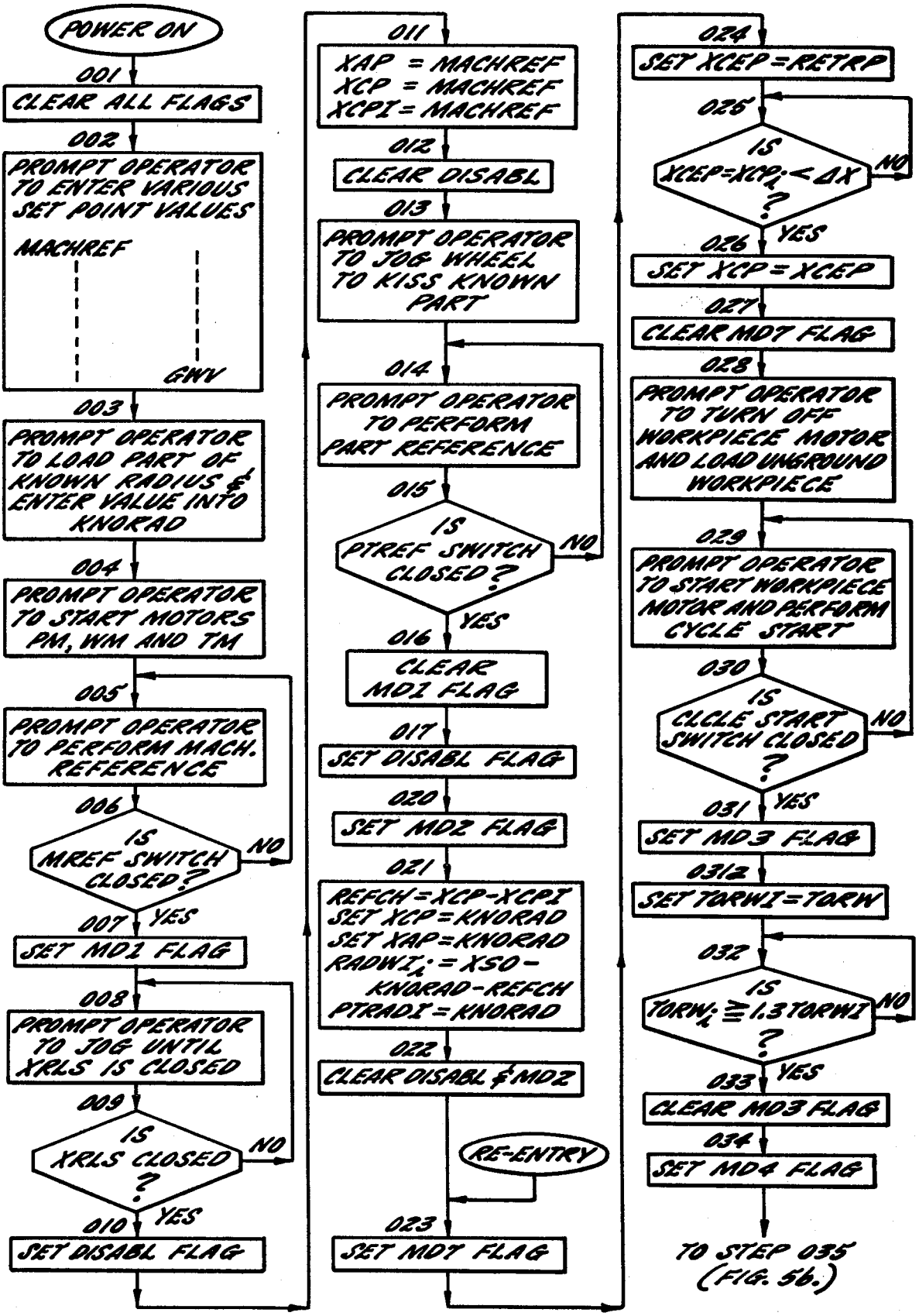
Figure 5B:
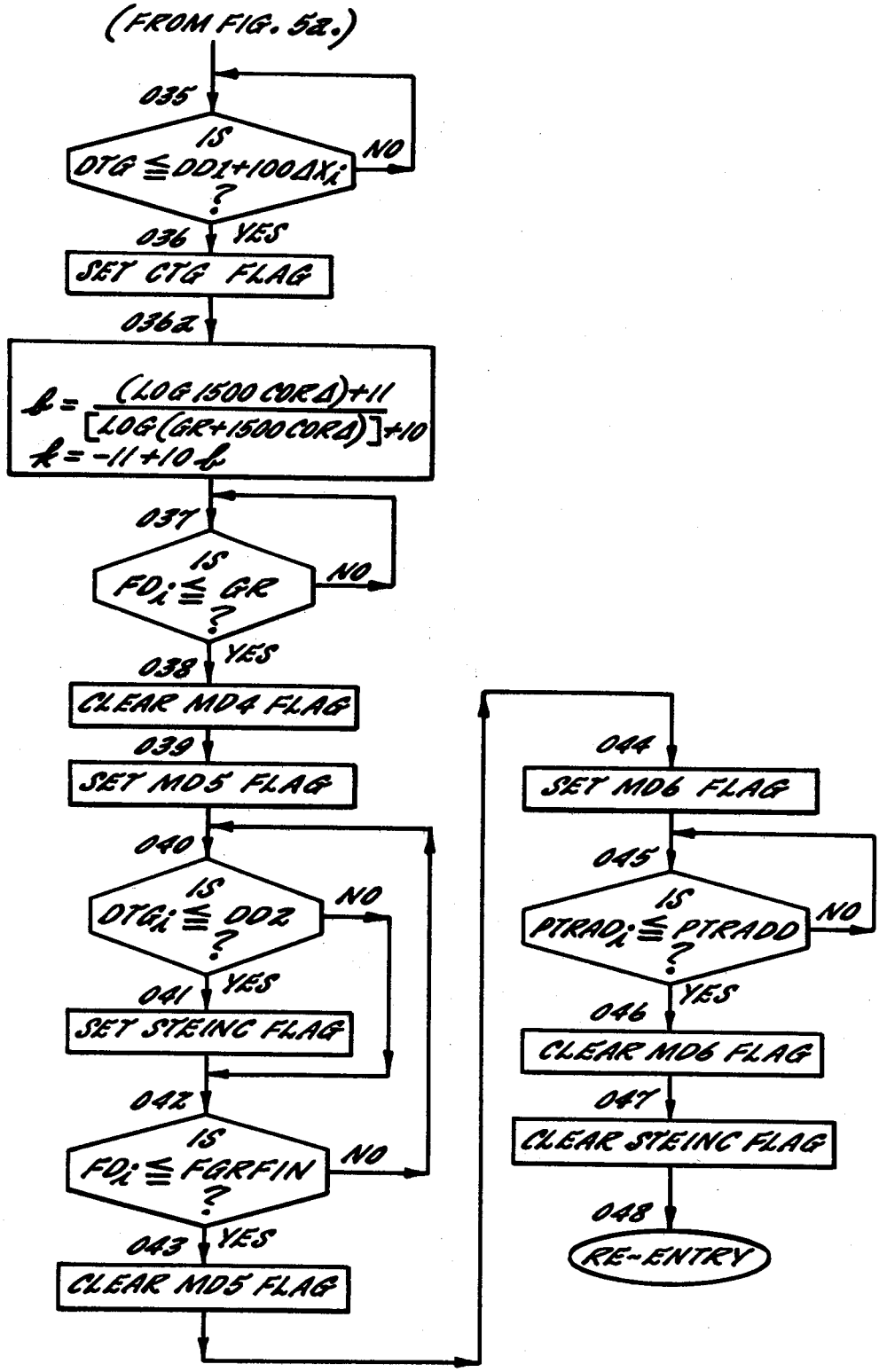
Figure 7:
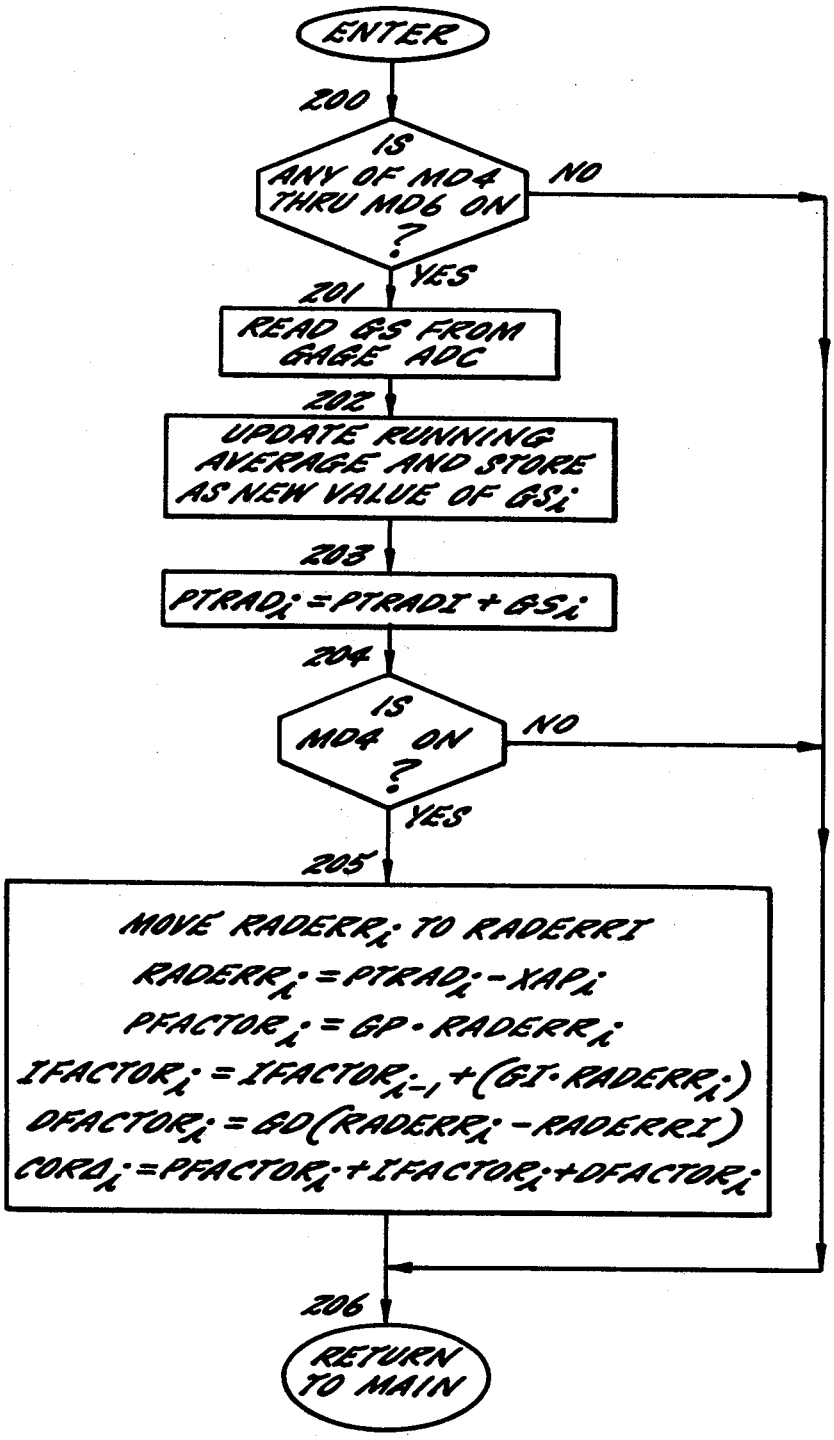
Figure 8A:
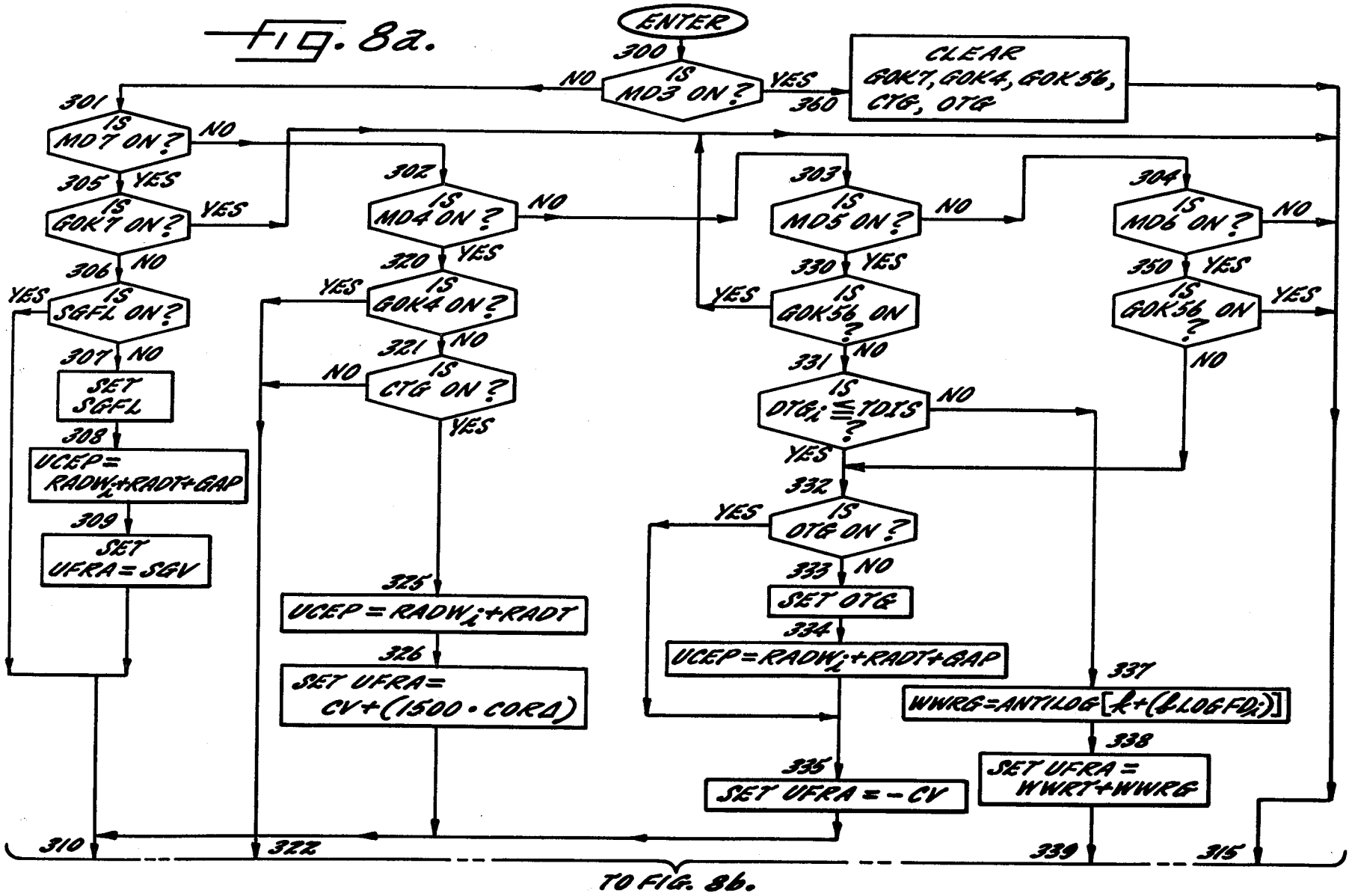
Figure 8B:
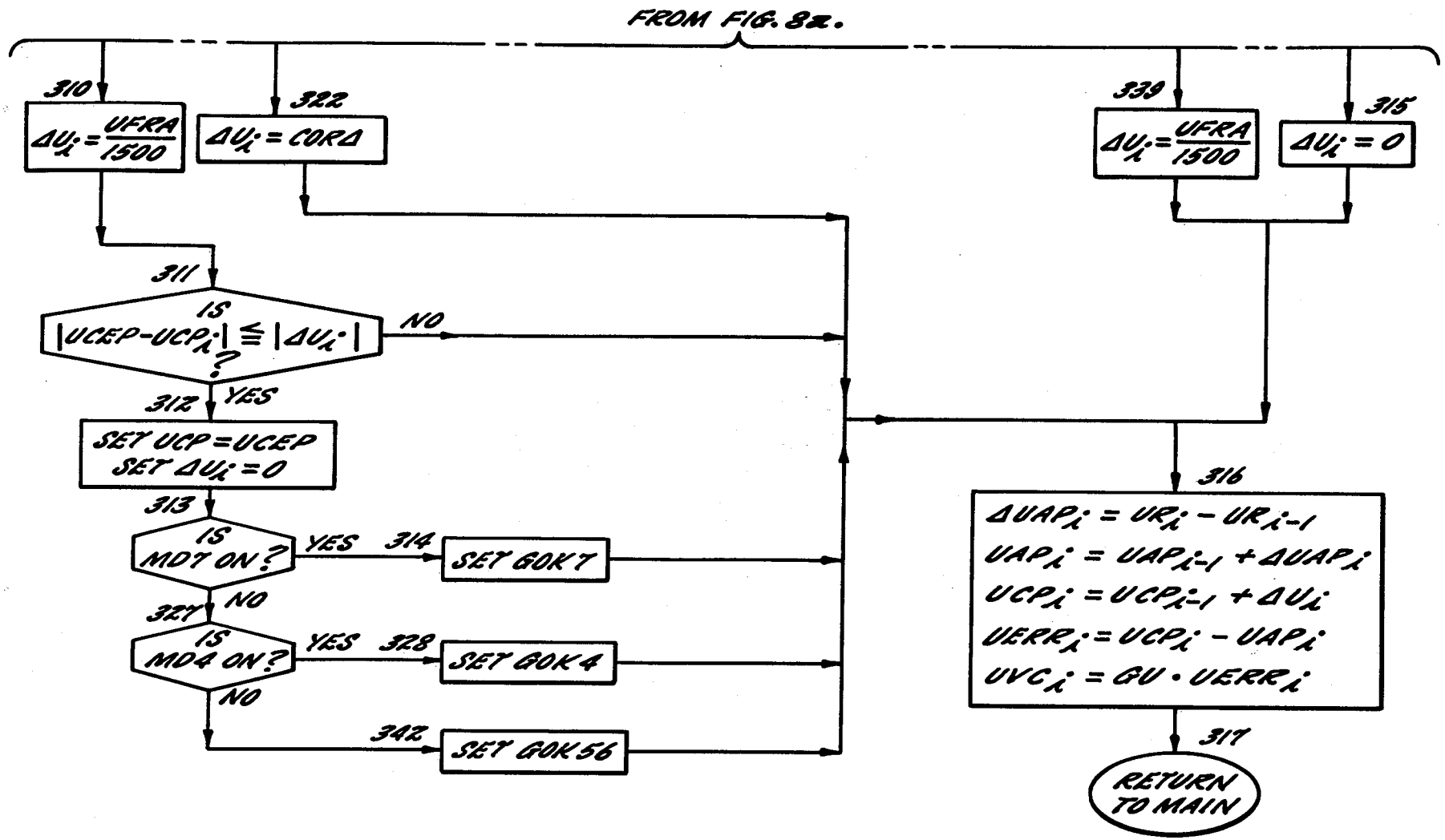
Figure 9:
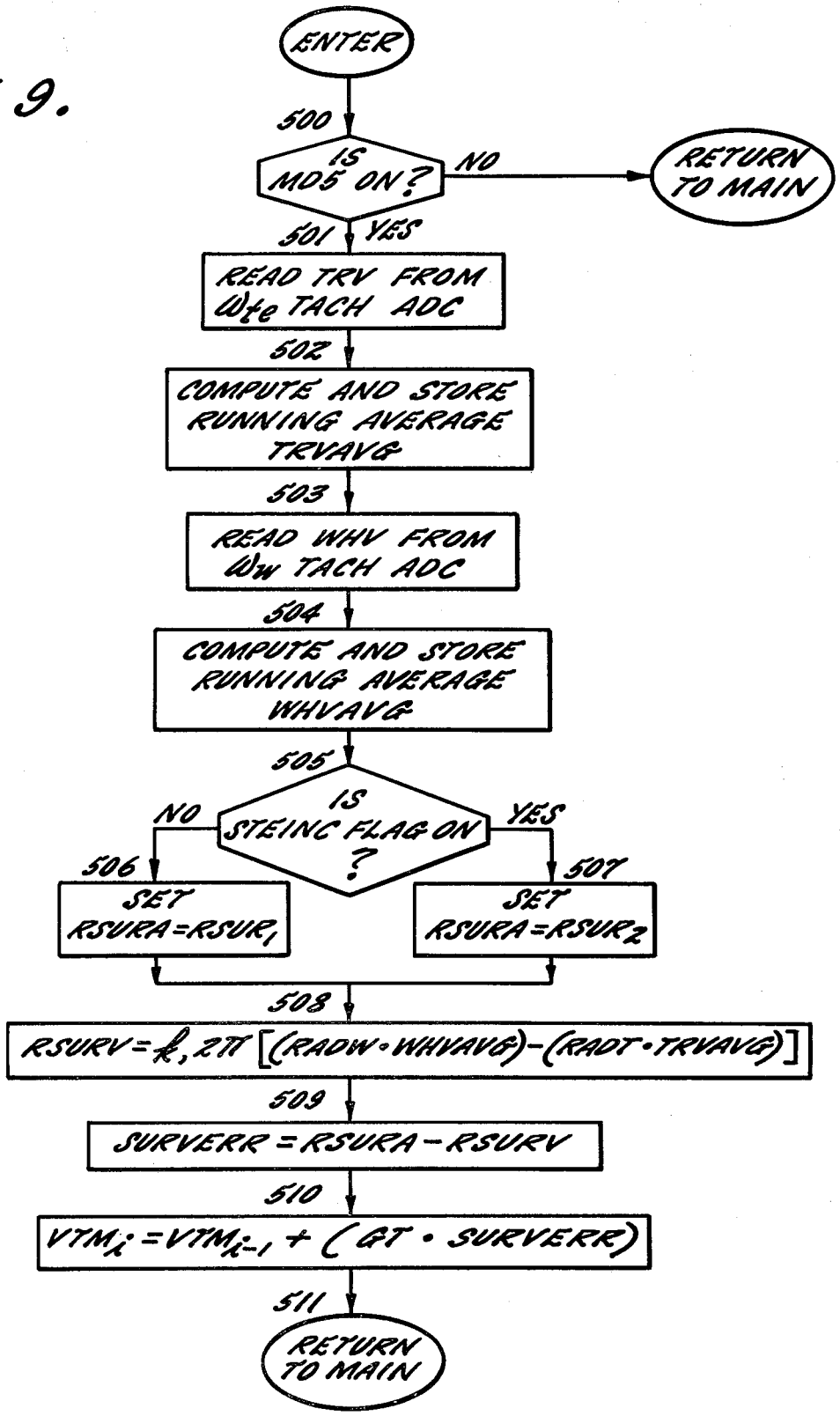
Figure 10:
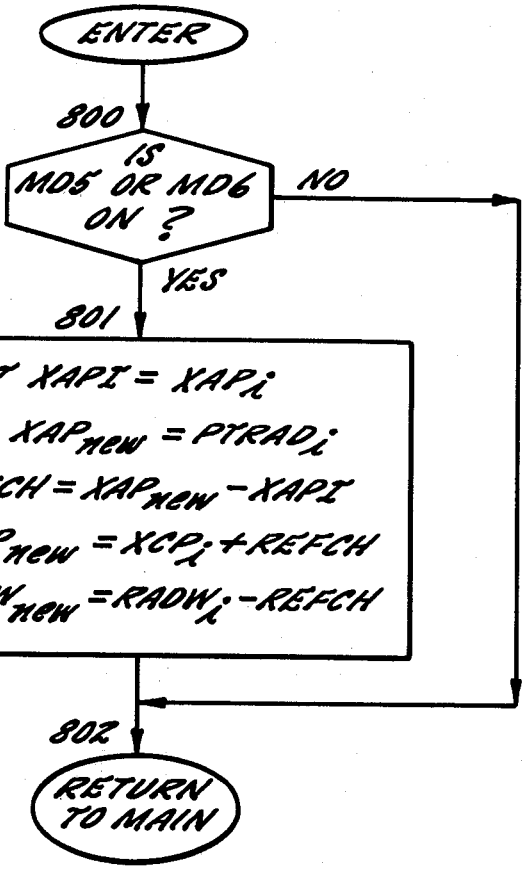
Figure 11:
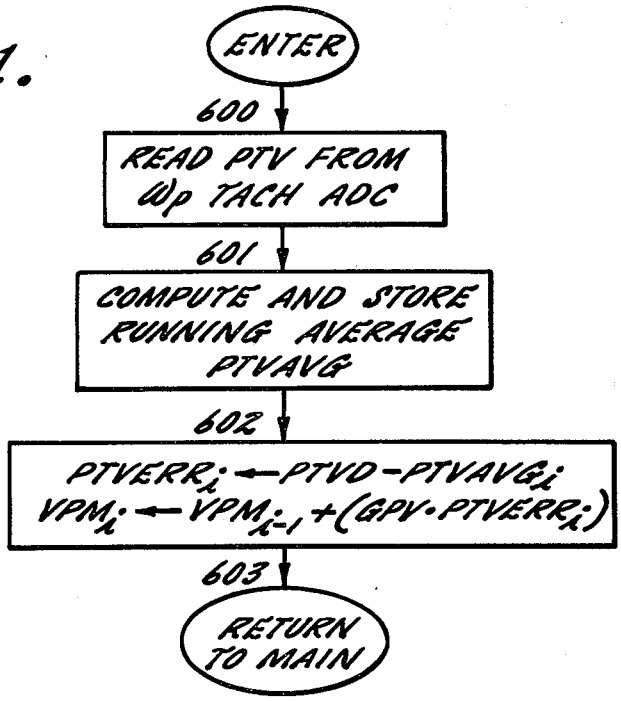
Figure 12:
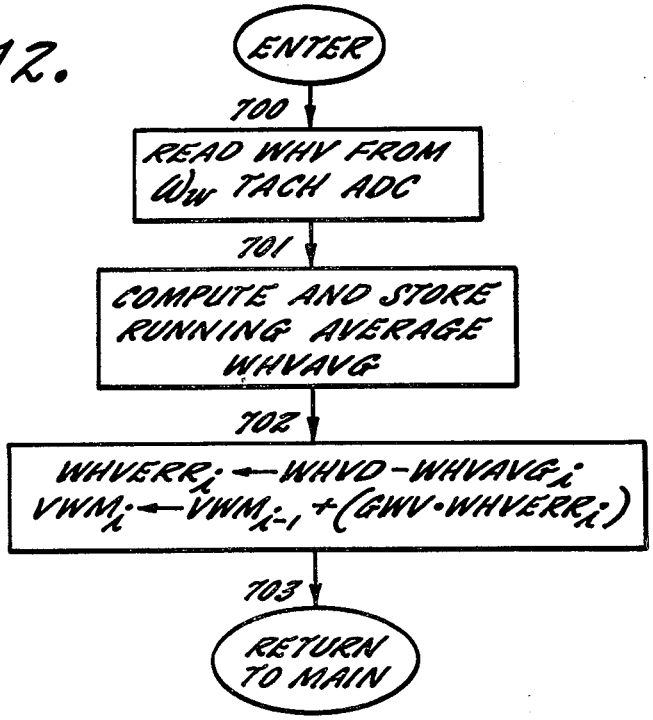

FIGS. 5*a* and 5*b* (hereinafter collectively referred to as FIG. 5) constitute a flow chart illustrating the sequences of operations carried out according to a main program stored in the memory of FIG. 3 and executed by the minicomputer of FIG. 2 for controlling the grinding machine of FIG. 1;

FIG. 6 is a flow chart illustrating the sequences of operations carried out according to a subroutine program stored in the memory of FIG. 3 and executed by the minicomputer of FIG. 2 for controlling the wheel slide feed motor WFM in the grinding machine of FIG. 1;

FIG. 7 is a flow chart illustrating the sequences of operations carried out according to a subroutine program stored in the memory of FIG. 3 and executed by the minicomputer of FIG. 2 for performing certain operations during modes 4, 5 and 6 of FIG. 4;

FIGS. 8*a* and 8*b* are a flow chart illustrating the sequence of operations carried out according to a subroutine program stored in the memory of FIG. and 3 executed by the minicomputer of FIG. 2 for controlling the truing slide feed motor TFM in the grinding machine of FIG. 1;

FIG. 9 is a flow chart illustrating the sequences of operations carried out according to a subroutine program stored in the memory of FIG. 3 and executed by the minicomputer of FIG. 2 for controlling the truing roll drive motor TM in the grinding machine of FIG. 1;

FIG. 10 is a flow chart illustrating the sequences of operations carried out according to a subroutine program stored in the memory of FIG. 3 and executed by the minicomputer of FIG. 2 for perfoming certain operations during modes 5 and 6 of FIG. 4;

FIG. 11 is a flow chart illustrating the sequences of operations carried out according to a subroutine program stored in the memory of FIG. 3 and executed by the minicomputer of FIG. 2 for controlling the workpiece drive motor PM in the grinding machine of FIG. 1; and FIG. 12 is a flow chart illustrating the sequences of operations carried out according to a subroutine program stored in the memory of FIG. 3 and executed by the minicomputer of FIG. 2 for controlling the wheel drive motor WM in the grinding machine of FIG. 1.

TYPICAL GRINDING MACHINE CONFIGURATION AND COMPONENTS

FIG. 1 diagrammatically shows a typical grinding machine with its various relatively movable components, together with various sensors and driving motors or actuators. Not all the sensors and actuators are required in certain ones of the method and apparatus embodiments to be described, but FIG. 1 may be taken as an "overall" figure illustrating all the various machine-mounted components which are employed in one embodiment or another, so long as it is understood that certain ones of such components are to be omitted in some cases.

The grinding machine is here illustrated by way of example as a cylindrical grinder but the invention to be disclosed below is equally applicable to all other types of grinding machines such as surface grinders, roll grinders, etc. The machine includes a grinding wheel 20 journaled for rotation about an axis 20*a* and rotationally driven (here, counterclockwise) by a wheel motor WM. The wheel 20 and its spindle or axis 20*a* are bodily carried on a wheel slide WS slidable along ways of the machine bed 22. As shown, the face 20*b* of the wheel is brought into relative rubbing contact with the work surface 24*b* of a part or workpiece 24, and the wheel face is fed relatively into the workpiece by movement of the carriage WS toward the left, to create abrasive grinding action at the work/wheel interface.

In the exemplary arrangement shown, the workpiece 24 is generally cylindrical in shape (or its outer surface is a surface of revolution) and supported on fixed portions of the machine bed 22 but journaled for rotation about an axis 24*a*. The workpiece is rotationally driven (here, counterclockwise) at an angular velocity $\omega_p$ by a part motor PM mounted on the bed 22. Since the workpiece and wheel surfaces move in opposite directions at their interface, the relative surface speed of their rubbing contact is equal to the sum of the peripheral surface speeds of the two cylindrical elements.

Any appropriate controllable means may be employed to move the slide WS left or right along the bed 22, including hydraulic cylinders or hydraulic rotary motors. As here shown, however, the slide WS mounts a nut 25 engaged with a lead screw 26 connected to be reversibly driven at controllable speeds by a wheel feed motor WFM on the bed. It may be assumed for purposes of discussion that the motor WFM moves the slide WS, and thus the wheel 20, to the left or the right, according to the polarity of an energizing voltage $V_{wfm}$ applied to the motor, and at a rate proportional to the magnitude of such voltage.

A position sensor in the form of a resolver 29 is coupled to the slide WS or the lead screw 26 to produce a signal XR which varies to represent the position of the wheel slide as it moves back and forth. In the present instance, the position of the wheel slide is measured along a scale 30 (fixed to the bed) as the distance between a zero reference point 31 and an index point 32 on the slide. The reference and index points 31 and 32 are for convenience of discussion here shown as vertically alined with the workpiece and wheel axes 24*a* and 20*a*, respectively, and the value $P_{ws}$ represents the position of the wheel axis 20*a* relative to the workpiece axis 24*a*.

In the practice of the invention in certain of its embodiments, it is desirable (for a purpose to be explained) to sense and signal the power which is being applied for rotational drive of the grinding wheel 20, and also to sense and signal the rotational speed of the wheel. While power may be sensed and signaled in a variety of ways, FIG. 1 illustrates for purposes of power computation a torque transducer 35 associated with the shaft which couples the wheel motor WM to the wheel 20. The torque sensor 35 produces a dc. voltage $TOR_w$ which is proportional to the torque exerted in driving the wheel to produce the rubbing contact described above at the interface of the wheel 20 and the workpiece 24. The wheel motor WM is one which is controllable in speed, and while the motor may take a variety of forms such as an hydraulic motor, it is here assumed to be a dc. motor which operates at a rotational speed $\omega_w$ which is proportional to an applied energizing voltage $V_{wm}$. As a convenient but exemplary device for sensing and signaling the actual rotational speed of the wheel 20, a tachometer 36 is here shown as coupled to the shaft of the motor WM and producing a dc. voltage $\omega_w$ proportional to the rotational speed (e.g., in units of r.p.m.) of the wheel 20.

In similar fashion, it is desirable in the practice of the invention according to certain ones of the embodiments to be described that the rotational speed of the workpiece or part 24 be signaled directly or indirectly. The rotational speed of the workpiece 24 is controllable, and in the present instance it is assumed that the motor PM drives the workpiece 24 at an angular velocity $\omega_p$ proportional to the magnitude of a dc. energizing voltage $V_{pm}$ applied to that motor. To sense the actual angular velocity of the rotationally driven workpiece 24, a tachometer 39 is coupled to the shaft of the motor PM and produces a dc. signal $\omega_p$ proportional to the workpiece speed.

Again, although not essential to the practice of the invention in all of its embodiments, FIG. 1 illustrates a typical and suitable arrangement for continuously sensing and signaling the size (i.e., radius) of the workpiece 24 as the latter is reduced in diameter due to the effects of grinding action. Such workpiece sensing devices are often called "in-process part gages", and one known type of such gage is a diametral gage 40 which has a pair of sensors 41 and 42 which ride lightly on the workpiece surface at diametrically spaced points. These sensors 41 and 42 are preferably located in the top and bottom of the workpiece to minimize any effect of workpiece deflection (due to the pressure of the grinding wheel) on the gage signal. The output signal from the gage 40 is directly proportional to the distance between the two sensors 41 and 42, which is the actual diameter $D_p$ of the workpiece at any given time. Since the workpiece diameter $D_p$ is twice the workpiece radius $R_p$, the gage signal is also proportional to the actual workpiece radius and thus has been designated "$R_p$" in FIG. 1.

As will be treated more fully below, as grinding of the part 24 by the wheel 20 proceeds, the wheel may not only become dull but its surface may deteriorate from the desired shape. Accordingly, it has been the practice in the prior art to periodically "dress" the grinding wheel to restore sharpness and/or periodically "true" the grinding wheel face in order to restore its shape or geometric form to the desired shape. These related procedures of dressing and truing will here be generically called "conditioning" the wheel face.

For future reference, it may be noted here that the grinding machine of FIG. 1 includes a conditioning element or truing roll 50 having an operative surface **50*b* which conforms to the desired wheel face shape. Whenever truing or dressing is required or desired, the operative surface of the truing roll 50 may be relatively fed into relative rubbing contact with the wheel face 20*b* in order to either wear away that wheel face so it is restored to the desired shape, or to affect the sharpness of the abrasive grits carried at the wheel face. Thus, FIG. 1 shows the truing roll 50 as being mounted for rotation about its axis 50*a* on a spindle supported by a truing slide TS movable to the left or right relative to the wheel slide WS. That is, the truing slide TS is slidable along the ways formed on the wheel slide WS and it may be shifted or fed to the left or the right relative to the index mark 32 by a truing feed motor TFM mechanically coupled to a lead screw 51 engaged with a nut 52 in the slide TS. The motor TFM has its stator rigidly mounted on the wheel slide WS so that as the lead screw 51** turns in one direction or the other, the slide TS is fed to the left or right relative to the wheel slide WS. The motor TFM is here assumed, for simplicity, to be a dc. motor which drives the lead screw in a direction which corresponds to, and at a speed which is proportional to, the polarity and magnitude of an energizing voltage $V_{tfm}$.

The position of the truing roll 50 and the truing slide TS is measured, for convenience, relative to the index mark 32 on the wheel slide WS. As here shown, an index mark 54 vertically alined with the axis **50*a* indicates the position $P_{ts}$ of the wheel 50 along a scale 55 on the wheel slide, such scale having its zero reference location alined vertically with the axis 20*a* and the index mark 32. In order that the position of the truing roll 50 may at all times be known, a resolver 58 is coupled to the lead screw 51 and produces a signal UR which varies with the physical position $P_{ts}$ of the truing slide TS along the scale 55** as the slide moves to the left or to the right.

When the conditioning element 50 is employed in a cylindrical grinding machine, it will usually take the form of a cylindrical roll having an operative surface which conforms to the desired shape of the wheel face. In order to produce the relative rubbing of the wheel and truing roll 50, the latter is rotationally driven or braked at controllable speeds by a truing motor TM which is mounted upon, and moves with, the truing slide TS. Merely for simplicity in the description which ensures, it is assumed that the motor TM is a dc. motor which may act bi-directionally, i.e., either as a source which drives the roll 50 in a clockwise direction or which affirmatively brakes the roll 50 (when the latter is driven c.w. by the wheel 20 in contact therewith) by torque acting in a c.c.w. direction. It is known in the motor art that a dc. motor may be controlled to act as a variable brake by regenerative action. Assuming that the grinding wheel 20 has been brought into peripheral contact with the roll 50, the motor TM may thus serve as a controllable brake producing a retarding effect proportional to an energizing voltage $V_{tm}$ applied thereto. If desired, one may view the motor as an electromagnetic brake creating a variable torque by which the rotational speed $_{te}$ of the truing roll 50 is controlled by variation of the applied voltage $V_{tm}$. In this fashion, the relative rubbing surface speed between the wheel face and the truing roll 50 may be controlled by controlling the braking effort exerted by the motor TM through a shaft coupled to the roll 50.

Also for a purpose which will become clear, the rotational velocity of the truing roll 50 is desirably sensed and signaled for reasons to be made clear. For this purpose, a tachometer 61 is coupled to the roll 50 or to the shaft of the motor/brake TM and it produces a dc. voltage $\omega_{te}$ which is proportional to the speed (expressible in r.p.m.) with which the roll 50 is turning at any instant.

In setting up a grinding system of the type illustrated in FIG. 1, the grinding wheel slide WS is always positioned initially at a known reference position fixed by a reference limit switch XRLS. When the wheel slide is in this position, the distance between the grinding wheel axis **20*a* and the workpiece axis 24*a*** is a known value.

FIG. 1A is a generic block representation of a control system 71 employed in the various embodiments of the invention to be described and which operates to carry out the inventive methods. In its most detailed form, the control system receives as inputs the signals XR, UR, $R_p$, $TOR_w$, $\omega_p$, $\omega_{te}$ and $\omega_w$ produced as shown in FIG. 1; and it provides as output signals the motor energizing signals $V_{pm}$, $V_{wm}$, $V_{tm}$ which determine the respective rotational speeds of the workpiece 24, wheel 50 and truing roll 50—as well as the signals $V_{wfm}$ and $V_{tfm}$ which determine the feed rates of the wheel slide WS and the truing slide TS. Yet, it will become apparent that not all the sensors, and signals representing sensed physical variables, need be used in the practice of all embodiments of the invention. Several typical but different embodiments will be described in some detail, both as to apparatus and method, in the following portions of the present specification.

Definitions and Symbols

Wheel Conditioning: The modification of the face of a grinding wheel (i) to affect its sharpness (making it either duller or sharper); or (ii) to affect its shape, essentially to restore it to the desired shape; or (iii) to carry out both functions (i) and (ii).

Wheel Conditioning Element: Any member having an operative surface conforming to the desired shape of a grinding wheel to be conditioned, and which can be brought into contact with the face of the wheel to create both relative rubbing and feeding which causes materal to be removed from the wheel (and in some cases undesireably causes material to be removed from the conditioning element). Throughout this specification the terms "truing" and "truing roll" will be used as synonymous with "conditioning" and "conditioning element" merely for convenience.

Relative Surface Speed: The relative surface velocity with which rubbing contact occurs at the wheel face-/operative surface interface. If the wheel surface is moving in one direction at 3000 feet per minute and the operative surface (workpiece or truing roll) is moving at 1000 feet per minute in the opposite direction, the relative surface speed is 4000 feet per minute. If the operative surface is not moving, then the relative speed of rubbing is equal to the surface speed of the wheel face due to wheel rotation. If the operative surface is moving in the same direction as the wheel face, the relative surface speed is the difference between the surface velocity of the wheel face and the surface velocity of the operative surface. If those two individual surface velocities are equal, the relative surface speed is zero, and there is no relative rubbing of the wheel face and operative surface, even though they are in contact. This latter situation exists during crush truing.

Relative Feed: The relative bodily movement of a grinding wheel and conditioning element which causes progressive interference as the relative rubbing contact continues and by which the material of the wheel is progressively removed. It is of no consequence whether the wheel is moved bodily with the conditioning element stationary (although perhaps rotating about an axis) or vice versa, or if both the wheel and element are moved bodily. Feeding is expressible in units of velocity, e.g., inches per minute.

Rate of Material Removal: This refers to the volume of material removed from a grinding wheel (or some other component) per unit time. It has dimensional units such as cubic centimeters per second or cubic inches per minute. In the present application alphabetical symbols with a prime symbol added designate first derivatives with respect to time, and thus the symbol W' represents volumetric rate of removal of material from a grinding wheel. In similar fashions, the symbols P' and TE' respectively represent volumetric rates of removal of material from a part (workpiece) and a truing roll.

From the introductory treatment of FIG. 1, it will also be apparent that the following symbols designate different physical variables as summarized below:

PWR = power, i.e., energy expended per unit time $PWR_w$ = power devoted by the wheel motor to rotationally drive a grinding wheel $PWR_{te}$ = power devoted by the truing element motor to drive or brake a truing element to create, in part, rubbing contact with wheel $PWR_{wt}$ = that portion of $PWR_w$ devoted to truing action $PWR_{wg}$ = that portion of $PWR_w$ devoted to grinding action $PWR_t$ = total power devoted to truing action $PWR_g$ = total power devoted to grinding action $TOR_p$ = torque exerted to drive the workpiece $TOR_w$ = torque exerted to drive the wheel $TOR_{te}$ = torque exerted to drive or brake the truing element $TOR_{wg}$ = that portion of total wheel torque $TOR_w$ applied to rubbing action at the grinding interface, when truing and grinding are occurring simultaneously $TOR_{wt}$ = similar to $TOR_{wg}$, but that portion of $TOR_w$ applied to rubbing action at the truing interface FOR = the force, in a direction tangential to a grinding wheel periphery, on a grinding wheel, a truing roll, or a workpiece due to rubbing action $\omega_w$ = rotational speed of grinding wheel (typically in units of r.p.m.)

$\omega_p$ = rotational speed of workpiece, i.e., the part to be ground $\omega_{te}$ = rotational speed of the truing element $S_w$ = the surface speed of the grinding wheel (typically in feet per minute)

$S_p$ = the surface speed of the workpiece or part $S_{te}$ = the surface speed of the truing element $S_r$ = the relative surface speed of rubbing contact $R_w$ = radius of grinding wheel $R_p$ = radius of workpiece or part $R_{te}$ = radius of truing element $P_{ws}$ = position of wheel slide $P_{ts}$ = position of truing slide (relative to wheel axis)

$F_{ws}$ = total feed rate (velocity) of wheel slide $F_{wsg}$ = feed rate (velocity) of wheel slide devoted to grinding action $F_{ts}$ = feed rate (velocity) of truing slide $R'_w$ = rate of radius reduction of wheel $R'_{wg}$ = rate of radius reduction of wheel due to grinding $R'_{wt}$ = rate of radius reduction of wheel due to truing $R'_p$ = rate of radius reduction of part being ground $R'_{te}$ = rate of radius reduction of truing element L = axial length of wheel face or region of grinding or truing contact M' = the volumetric rate of removal of material (metal) from the part being ground. Exemplary units: cubic inches per min.

W' = the volumetric rate of removal of material from the wheel. Exemplary units: cubic inches per min.

NOTE: Any of the foregoing symbols with an added "d" subscript represents a "desired" or set point value for the corresponding variable. For example, $\omega_{wd}$ represents a commanded or set point value for the rotational speed of the wheel. Similarily, any of the foregoing symbols with an added "o" subscript represent an original or initial value for the corresponding variable.

Certain ones of the foregoing symbols will be explained more fully as the description proceeds.

The parameter "Specific Truing Energy" (herein designated STE) can be defined as:

STE = Specific Truing Energy: the ratio of (i) energy consumed in removing wheel material to (ii) the volume of such material removed. The same ratio is represented by the ratio of (i) power expended (energy per unit time) to (ii) rate of material removal (volume of material removed per unit time)—i.e., PWR/W'. Exemplary units: Horsepower per cubic inch per minute, or gram-centimeters per second per cubic centimeter per second.

The uses and benefits of STE are described in detail in copending U.S. patent application Ser. No. 249,192, filed Mar. 30, 1981, for "Grinding Control Methods and Apparatus," which is assigned to the assignee of the present invention.

The Power Function Relationship Between Radius Reduction Rate And Feed Rate

The present invention will be more clearly understood by beginning with a discussion of a simplified, hypothetical pair of rotating cylinders C1 and C2 in rubbing contact with each other. The two cylinders C1 and C2 are fed into each other at a feed rate F, and the rubbing contact between the two cylinders reduces the respective radii R1 and R2 at rates $R'_1$ and $R'_2$ respectively. The two cylinders C1 and C2 may represent, for example, a workpiece and a grinding wheel, or a grinding wheel and a truing roll.

For any given set of grinding conditions, there is a power function relationship between the feed rate F and the rates of reduction of the radii R1 and R2 of the cylinders C1 and C2 at the rubbing interface. These power function relationships can be defined by the following equations:

| Cylinder *C1* | Cylinder *C2* | |
|---|---|---|
| $R'_1 = k_1F^a$ | $R'_2 = k_2F^b$ | (1,2) |

The values of the exponents a and b in the above equations are different for different sets of grinding conditions. For example, the values of these exponents vary with changes in the respective radii R1 and R2, the relative surface velocity $S_r$ of rubbing contact at the rubbing interface, the composition or hardness of either cylinder, the surface conditions of the cylinders (particularly the "sharpness" of a grinding wheel surface), etc. Thus, a significant change in one or more of these conditions will result in a change in the value of one or more of the exponents in the above equations.

The relationships defined by the above equations are power functions, which in general are represented by the equation $$y=ax^n \tag{3}$$

It is known that the curves represented by the above power function Equation (3) must pass through the origin (x=o, y=o) in a linear coordinate system, and that such curves will always pass through the point (x=1, y=a), regardless of the value of n, because $x^n$ is always 1 when x is 1.

It is also known that the curves represented by Equation (3) are always straight lines in a log-log coordinate system, as can be seen from the equation.

$$\log y=a+n \log x \tag{4}$$

Thus, if Equations (1) and (2) above are generalized as $$R'=kF^b \tag{5}$$

such equation can be rewritten as $$\log R'=k+b \log F \tag{6}$$

If two specific points ($R'_1$, $F_1$) and ($R'_2$, $F_2$) on the log-log curve are known, Equation (6) yields the following two equations:

$$\log R'_1=k+b \log F_1 \tag{7}$$

$$\log R'_2=k+b \log F_2 \tag{8}$$

Equations (7) and (8) can then be solved for k and b, viz:

$$b = \frac{\log R'_2 - \log R'_1}{\log F_2 - \log F_1} \tag{9}$$

$$k = \log R'_1 - \log F_1 \frac{\log R'_2 - \log R'_1}{\log F_2 - \log F_1} \tag{10}$$

$$= \log R'_1 - b \log F_1$$

Thus it can be seen that Equations (9) and (10) can be used to determine the values of both b and k from only two points ($R'_1$, $F_1$) and ($R'_2$, $F_2$) on the curve defined by Equation (5). It is known that one point lies close to the origin (R'=0, F=0), and thus one point can be assumed to be represented by R' and F values close to zero, such as $R'_1=10^{-11}$ and $F_1=10^{-10}$. Consequently, knowledge of only one other data point ($R'_2$, $F_2$), e.g., determined from actual measurements, can be used to determine the values of b and k from:

$$b = \frac{\log R'_2 - \log 10^{-11}}{\log F_2 - \log 10^{-10}} = \frac{\log R'_2 - (-11)}{\log F_2 - (-10)} \tag{11}$$

$$k = \log 10^{-11} - \log 10^{-10} \frac{\log R'_2 - \log 10^{-11}}{\log F_2 - \log 10^{-10}} \tag{12}$$

$$= -11 + 10b$$

Consequently, the value of the coefficient k and the exponent b can be determined from a single set of data for the feed rate F and one of the radius reduction rates $R'_1$ or $R'_2$. For example, if a feed rate F of 0.1 inch/minute produces a wheel wear rate $R'_w$ of 0.05 inch/minute in a given grinding system, the value of the exponent b in the power function $R'_w=kF^b$ can be computed as follows:

$$b = \frac{\log R'_w + 11}{\log F + 10}$$

$$= \frac{\log 0.05 + 11}{\log 0.1 + 10}$$

$$= \frac{-1.30103 + 11}{-2 + 10}$$

$$= 1.2123713$$

and the value of the coefficient k can be computed as:

$$k = -11 + 12.123713$$

$$= 1.123713$$

Of course, any measured value is accurate only within the limits of experimental error in taking the measurements, and thus it is normally preferred to use several sets of data (F, $R'_1$) or (F, $R'_2$) and then average the resulting values to minimize the effect of experimental errors.

The value of the radius reduction rate $R'_1$, or $R'_2$ used to compute k and b is usually not measured directly, but rather computed from successive measurements of the actual radius of one of the cylinders C1 and C2 using a gage. The actual rate $R'_1$ at which the radius $R_1$ is reduced, for example, can be expressed as $$R'_1 = \frac{\Delta R_1}{\Delta T} \tag{13}$$

where $\Delta R_1$ is the reduction in the workpiece radius in the time interval $\Delta T$. By repetitively measuring $\Delta R_1$ in successive time intervals $\Delta T$, and continually averaging the resulting values of $R'_1$ over the last N (e.g., 10) $\Delta T$'s, the value of $R'_1$ can be monitored with a high degree of accuracy.

In the steady state (i.e., ignoring deflection and springback of the cylinders, which occurs during acceleration and deceleration of F), the feed rate F will always be equal to the sum of the two radius reduction rates $R'_1$ and $R'_2$, or $$F = R'_1 + R'_2 \quad (14)$$

Thus, the value of $R'_1$ determined from the gage measurements can be used to compute the value of $R'_2$ as $$R'_2 = F - R'_1 \quad (15)$$

Consequently, the values of both the coefficient $k_1$ and $k_2$ and both the exponents a and b can be determined for Equations (1) and (2) above from a single measured data point ($F_1$, $R'_1$) or ($F_1$, $R'_2$).

The accuracy of the values determined for the coefficients and exponents depends not only on the accuracy with which the feed rates and radius reduction rates are determined, but also on the similarity of the materials and conditions in (1) the grinding operation in which measurements are taken to determine actual feed rate and radius reduction rate values to compute the coefficient and exponent values and (2) the grinding operation in which the computed coefficient and exponent values are later used. More specifically, the computed values of the coefficient and exponents will usually have the highest degree of accuracy when the two grinding operations involve the same workpiece and grinding wheel materials, the same grinding wheel radius, and the same relative surface velocity at the rubbing interface.

A Grinding System With Improved Finish Grinding

In accordance with one important feature of the present invention, a system for finish grinding a workpiece includes the steps of monitoring the actual radius of the workpiece as the finish grinding progresses; feeding the grinding wheel into the workpiece at a feed rate which decreases, preferably at an exponential rate, as a desired final radius of the workpiece is approached; and terminating the feeding of the grinding wheel at the desired final radius of the workpiece. The grinding wheel feed rate is preferably decreased as a function of the remaining distance between the wheel face and the desired final radius of the workpiece.

As a further important feature of the invention, the grinding wheel is trued, simultaneously with the finish grinding, by feeding a truing element into the grinding wheel at a rate that varies as a function of the decreasing rate at which the grinding wheel is fed into the workpiece. The truing element is preferably advanced toward the grinding wheel at a rate which has (1) a first component corresponding to the rate at which it is desired to remove material from the grinding wheel at the truing interface and (2) a second component corresponding to the wear rate of the grinding wheel due to grinding, the second component varying as a function of the rate at which the grinding wheel is fed into the workpiece. The grinding wheel is preferably advanced toward the workpiece at a rate which has (1) a first component corresponding to the decreasing feed rate at which the wheel is fed into the workpiece and (2) a second component corresponding the rate at which material is removed from the grinding wheel at the truing interface. The wear rate of the grinding wheel due to grinding is determined from the power function relationship between the wheel wear rate and the wheel feed rate for a particular grinding operation, i.e., a particular grinding wheel, workpiece material, relative surface velocity at the grinding interface, and other specified conditions affecting the rate of wheel wear due to grinding.

In the preferred embodiment of the present invention, the wheel slide feed rate is decelerated as an exponential function of time during finish grinding, while simultaneously truing the grinding wheel. Thus, the grinding wheel is being worn down simultaneously at the grinding interface and the truing interface, and at the same time the wheel slide feed rate is decelerating according to a predetermined schedule. As a further complication, it is preferred to maintain some control over the STE so that the desired surface finish is achieved on the final ground part.

The primary operator-selected set points in the finish grinding operation are:

(1) the gain factor which determines the rate of deceleration of the wheel feed rate $F_w$, (2) the desired truing Rate $R'_{wtd}$, i.e., the rate at which material is to be removed from the grinding wheel during the simultaneous truing and grinding, (3) the desired relative surface velocity $S_r$ at the truing interface, to provide the desired degree of control of STE, (4) the desired grinding wheel speed $\omega_{wd}$, and (5) the desired workpiece speed $\omega_{pd}$.

Controlled parameters include (4) and (5) above plus wheel slide feed rate $F_{ws}$, truing slide feed rate $F_{ts}$ and truing roll speed $\omega_{te}$, the set points for which are computed from the five operator-selected set points. The control of these latter three parameters is particularly important because they are the principal means of achieving the desired wheel slide deceleration rate, the desired truing rate $R'_{wt}$, and the desired relative surface velocity $S_r$ at the truing interface.

The set points for the two slide feed rates $F_{ws}$ and $F_{ts}$ must be changed frequently to maintain the desired deceleration rate and truing rate, but in order to compute these set points the wheel wear rate $R'_{wg}$ at the grinding interface must first be determined. From the commanded wheel feed rate $F_w$ at any given instant and predetermined values of the coefficient k and the exponent b, the wheel wear rate $R'_{wg}$ at the grinding interface can be computed from the equation $$R'_{wg} = \text{antilog}[k + (b \log F_w)] \quad (16)$$

To understand how this Equation (16) is derived, it is helpful to start with an overall view of the power function relationship involved in a simultaneous truing and grinding operation involving a workpiece with a radius $R_p$, a grinding wheel with a radius $R_w$ and fed into the workpiece at a rate $F_w$, and a truing roll with a radius $R_{te}$ and fed into the grinding wheel at a rate $F_t$. The power function equations for such an operation are as follows:

| Grinding Interface | | Truing Interface | | |
|---|---|---|---|---|
| Workpiece | Grinding Wheel | Grinding Wheel | Truing Roll | |
| $R'_9 = k_1 F_w^a$ | $R'_{wg} = k_2 F_w^b$ | $R'_{wt} = k_3 F_t^c$ | $R'_{te} = k_4 F_t^d$ | (17-20) |

It should be noted that the truing roll feed rate Ft in the above equations is not the same as the truing slide feed rate $F_{ts}$. The truing slide must be advanced at a rate $F_{ts}$ that is equal to the sum of not only the two radius reductions taking place at the truing interface, but also the reduction in the radius of the grinding wheel effected at the grinding interface. That is:

$$F_{ts}=R'_{te}+R'_{wt}+R'_{wg} \quad (21)$$

The effective feed rate $F_t$ of the truing roll face at the truing interface, however, is equal to the sum of only the two radius reductions taking place at the truing interface. Thus:

$$F_t=R'_{te}+R'_{wt} \quad (22)$$

Although the rotational axis of the truing roll actually advances at the same rate $F_{ts}$ as the truing slide, a portion of that advance is merely closing the gap that would be opened by the removal of grinding wheel material at the grinding interface at the rate $R'_{wg}$. The rate $F_t$ at which the truing roll face actually feeds into the grinding wheel is, therefore, the truing slide feed rate $F_{ts}$ minus $R'_{wg}$, or $$\begin{aligned} F_t &= F_{ts} - R'_{wg} \quad (23) \\ &= R'_{te} + R'_{wt} + R'_{wg} - R'_{wg} \\ &= R'_{te} + R'_{wt} \end{aligned}$$

thereby confirming the accuracy of Equation (22) above.

Similarly, at the grinding interface the grinding wheel feed rate $F_w$ is not the same as the wheel slide feed rate $F_{ws}$. The wheel slide must be advanced at a rate $F_{ws}$ that is equal to the sum of not only the two radius reductions taking place at the grinding interface, but also the reduction in the radius of the grinding wheel effected at the truing interface. That is $$F_{ws}=R'_p+R'_{wg}+R'_{wt} \quad (24)$$

The effective feed rate $F_w$ of the grinding wheel face at the grinding interface, however, is equal to the sum of only the two radius reductions taking place at the grinding interface. Thus:

$$F_w=R'_p+R'_{wg} \quad (25)$$

Although the rotational axis of the grinding wheel actually advances at the same rate $F_{ws}$ as the wheel slide, a portion of that advance is merely closing the gap that would be opened by the removal of grinding wheel material at the truing interface at the rate $R'_{wt}$. The rate at which the grinding wheel face actually feeds into the workpiece is, therefore, the wheel slide feed rate $F_{ws}$ minus $R'_{wt}$ or $$\begin{aligned} F_w &= F_{ws} - R'_{wt} \quad (26) \\ &= R'_p + R'_{wg} + R'_{wt} - R'_{wt} \\ &= R'_p + R'_{wg} \end{aligned}$$

hereby confirming the accuracy of Equation (25) above.

In the simultaneous truing and grinding method used in the present finish grinding system, the wheel feed rate $F_w$ is known because it is a commanded value computed using the gain factor mentioned above, as will be described in more detail below. Thus, using Equation (27), the value of $R'_{wg}$ can be computed as $$R'_{wg}=kF_w^b \quad (27)$$

$$\log R'_{wg}=k+b \log F_w$$

$$R'_{wg}=\text{antilog}[k+(b \log F_w)]$$

The set point for the truing slide feed rate $F_{ts}$ can now be computed using Equation (21), because $R'_{wt}$ already has a set point value and $R'_{te}$ is either known or, more commonly, assumed to be zero because the truing roll wears so slowly. The set point for the wheel slide feed rate $F_{ws}$ is simply the commanded wheel feed rate $F_w$ plus the truing rate $R'_{wt}$ or $$F_{ws}=F_w+R'_{wt} \quad (28)$$

per Equation (26) above.

The preferred means for controlling the grinding apparatus of FIG. 1, using the control method described above, is a software-programmed digital minicomputer or microprocessor illustrated in FIG. 2 although it could, if desired, be implemented in an analog computer using d-c. voltages to indicate signal values, or as a hard-wired iterative computer programmed by its wiring connections. The internal construction details of digital minicomputers are well known to those skilled in the art, and any of a wide variety of such computers currently available in the United States market may be chosen.

By way of background, and as is well known, the computer includes a clock oscillator 70 (FIG. 2) which supplies pulses at a relatively high and constant frequency to a timing signal divider 71 which in turn sends timing signals to the other computer components so that elementary steps of fetching signals from memory, performing arithmetic operations, and storing the results are carried out in rapid sequence according to a stored master program of instructions. For this purpose, the computer includes an arithmetic-logic unit (ALU) 72 served by an input trunk 73. An accumulator 75 receives the output from ALU and transmits it over an output trunk 76. The output from the accumulator is sent back as an operand input to the ALU in certain arithmetic or comparing steps. These trunks are multiconductor wires which carry multi-bit signals representing in binary or BCD format numerical values of variables which change as a result of inputs from a tape reader 77 or computations performed by the ALU 72. The tape reader 77 is coupled to the computer via a decoder 78 and an input/output interface 79.

The computer includes signal storage registers within a system storage or "memory" 80 which functionally is divided into sections containing instruction units **80*a* and data units 80*b*, as explained more fully below. The memory registers in the instruction section 80*a* are set by reading in and storage of a "master program" to contain multi-bit words of instruction which designate the operations to be performed in sequence, with logic branching and interrupts. The instruction memory contains the master program and sets up the gates and controls of the general purpose minicomputer to convert it into a special purpose digital control apparatus, the pertinent portion of that program being described hereinafter. Although a single minicomputer has been illustrated in FIG. 2 for carrying out all the functions needed to control the grinding machine of FIG. 1**, it will be understood that these functions can be split among separate minicomputers arranged to share tasks by cross-talking through a common bus.

Since the organization and operation of the digital computer as well known, it will suffice to observe briefly that advancement of a program counter 81 to an address number will cause address selection and routing gates 82 to read the addressed memory instruction onto the input trunk 73 and into an instruction register 84. The operation code in the latter is decoded and sent to the ALU 72 to designate the operation to be performed next (e.g., add, subtract, complement, compare, etc.). It is herein assumed for ease of discussion that the ALU will algebraically add two operands unless instructed to subtract, multiply, divide, and so on. The data address in the instruction register is transferred to and conditions the storage address and routing gates 85 to fetch from memory the data word to be used next as an operand, the multi-bit signals being sent via the trunk 73 to the input of the ALU. At the conclusion of an arithmetic or logic sequence, the result or answer appears in the accumulator 75 and is routed via the trunk 76 through the gates 85 to an appropriate location or register in the memory 80. The gates 85 are controlled by the data address output of the instruction register, so that an answer is sent for storage to the proper memory location, replacing any numeric signals previously stored there.

FIG. 3 is an expanded diagrammatic illustration of the computer memory, with the pertinent storage registers or locations having acronym labels to make clear how certain signals are created and utilized. The program instruction section 80*a* contains a very large number of instruction words which are formulated to cause orderly sequencing through the master program, with branching and interrupts. To avoid a mass of detail and yet fully explain the invention to those skilled in the art, the pertinent program instructions are not labeled in FIG. 3 but are set out in flow charts to be described below.

As indicated in FIG. 3, the primary command signals in this particular example are labeled "XVC", "UVC", "VPM", "VWM" and "VTM". These five digital signals are passed through digital-to-analog converters 101 through 105, respectively, to produce the five voltages $V_{wfm}$, $V_{tfm}$, $V_{pm}$, $V_{wm}$ and $V_{tm}$ which drive the respective motors WFM, TFM, PM, WM and TM in FIG. 1.

Thus, the command signals XVC, UVC, VPM, VWM and VTM control the wheel slide feed rate $F_{ws}$, the truing slide feed rate $F_{ts}$, the rotational velocity, $\omega_p$ of the workpiece 24, the rotational velocity $\omega_w$ of the grinding wheel 20, and the rotational velocity of the truing roll 50.

FIG. 3 also shows that the transducer signals XR, UR, $\omega_p$, $\omega_w$, $\omega_{te}$, $R_p$ and $TOR_w$ from FIG. 1 are brought into the storage section 80*b* from the resolvers 29 and 58, the tachometers 39, 36 and 61, the gage 40, and the transducer 35, respectively. These analog signals are passed through respective analog-to-digital converters 106 through 112 to produce corresponding digital signals labeled "XR", "UR", "PTV", "WHV", "TRV", "GS" and TORW respectively. These signals are treated as if they came from storage units, and thus by appropriate instruction they can be retrieved and sent to the ALU 72.

The diagonal lines at the corners of certain rectangles in FIG. 3 are intended to indicate that the word stored and signaled in that register is a predetermined numerical constant. Of course, the stored number or constant is readily adjustable by reading into the register a different value via a manual data input keyboard or as a part of the master program. As in the case of the transducer signals, these predetermined constant but adjustable signals can also be retrieved and sent to the ALU 72 by appropriate instructions.

The storage section 80*b* in the memory diagram in FIG. 3 contains means for producing various signals which are utilized and changed periodically, to the end objective of energizing correctly the five motors WFM, TFM, PM, WM and TM. Such means include memory or storage units which are identified by acronyms which signify not only the storage units but also the signals produced thereby. The quantity represented by the changeable number in any register may be represented by the same acronym, and these numbers can be changed in value by programmed computations or transfers effected by the ALU under control of the stored master program. The acronyms are too numerous to permit all of them to be identified in FIG. 3, but a complete listing is as follows (including signals used in Example II to be described below, even if not used in the present Example I:

PTRAD = $R_p$ = workpiece radius
PTRADD = $R_{pd}$ = desired final workpiece radius (after grinding)
KNORAD = known radius of master part
RADW = $R_w$ = grinding wheel radius
WWR = $R'_w$ = wheel wear rate
WWRG $R'_{wg}$ = wheel wear rate due to grinding
WWRT = $R'_{wt}$ = wheel wear rate due to truing
XAP = actual position of wheel face relative to rotational axis of workpiece, sometimes artificially adjusted by a quantity XCORΔ to make distance from rotational axis of workpiece seem smaller than it actually is.
ΔXAP = change in XAP in ΔT
XR = resolver signal indicating actual position of wheel slide
XCEP = a commanded end position to which wheel face is to be moved
XCP = commanded position of wheel face relative to rotational axis of workpiece
ΔX = the increment by which XCP is changed for each ΔT, i.e., the commanded wheel slide feed rate in inches per ΔT
RADERR = difference between actual workpiece radius PTRAD and XAP
CORΔ = sum of PFACTOR, IFACTOR and DFACTOR, used to artificially adjust XAP to compensate for wheel in PID servo control loop
XERR = difference between XCP and XAP
XVC = drive signal for wheel slide feed motor WFM
ΔT = iteratron internal for the iterative control system
COUNT = number of ΔT's
GX = preselected constant, but adjustable, signal representing proportional gain factor to be applied to RADERR in deriving PFACTOR
GXI = preselected constant, but adjustable, signal representing integral gain factor to be applied to RADERR in deriving IFACTOR
GXD = preselected constant, but adjustable, signal representing derivatives gain factor to be applied to RADERR in designing DFACTOR
PFACTOR = proportional gain factor in PID servo loop controlling wheel slide motor WFM
IFACTOR = integral gain factor in PID servo loop controlling wheel slide motor WFM
DFACTOR = derivative gain factor in PID servo loop controlling wheel slide motor WFM PTV=actual rotational velocity of workpiece
PTVD=desired rotational velocity of workpiece
PTVERR=difference between PTV and PTVD
VPM=drive signal for workpiece motor PM
GPV=preselected constant, but adjustable, signal representing gain factor to be applied to PTERR in deriving VPM
WHV=actual rotational velocity of grinding wheel
WHVD=desired rotational velocity of grinding wheel
WHVERR=difference between WHV and WHVD
VWM=drive signal for wheel motor WM
GPW=preselected constant, but adjustable signal, representing gain factor to be applied to WHVERR in deriving VWM
TRV=actual rotational velocity of truing roll
TRVD=desired rotational velocity of truing roll
TRVERR=difference between TRV and TRVD
VTM=drive signal for truing roll motor TM
GTM=preselected constant, but adjustable, signal representing gain factor to be applied to TRVERR in deriving VTM
RADT=$R_{te}$=truing roll radius
GAP=preselected constant, but adjustable, signal representing desired distance between truing roll face and grinding wheel face when truing roll is "following with a gap"
UFRA=commanded truing slide feed rate in inches per minute
SGV=preselected constant, but adjustable, signal representing the desired value of UFRA during movement of truing slide to establish GAP
CV=preselected constant, but adjustable, signal representing value to be added to CORΔ to derive the desired value of UFRA during advancement of the truing roll into engagement with the grinding wheel, and during retracting movement of truing roll
ΔU=the commanded truing slide feed rate in inches per ΔT
GU=preselected constant, but adjustable, signal representing gain factor to be applied to VERR in deriving UVC
UR=resolver signal indicating actual position of truing slide
UCEP=a commanded end position to which truing roll face is to be moved
MACHREF=a preselected constant, but adjustable, signal representing the distance between the rotational axis of the workpiece and the face of the grinding wheel when the wheel is engaging the reference limit switch XRLS and when the wheel has a selected radius (e.g., 12 inches)
TORW=$TOR_w$=torque exerted to drive grinding wheel
REFCH=different between XCPI and XCP
XSO=a preselected constant, but adjustable, signal representing distance between rotational axes of workpiece and grinding wheel when wheel is in reference position (engaging XRLS)
RETRP=a preselected constant, but adjustable, signal representing a "parked" position to which the grinding wheel is returned before the grinding of any new workpiece is started
DTG=the difference between the current workpiece radius PTRAD and the desired final radius PTRADD
DD=a preselected constant, but adjustable, signal representing a particular value of DTG at which a commanded event is to occur
GS=a signal from gage 40, proportional to current workpiece radius PTRAD
XFRA=commanded wheel slide feed rate in inches per minute
FJOG=preselected constant, but adjustable, signal representing the desired value of XFRA during a "jogging" mode
FGAP=preselected constant, but adjustable, signal representing the desired value of XFRA during a "gap closing" mode when the wheel is being advanced into engagement with the workpiece
GR=preselected constant, but adjustable, signal representing the desired value of XFRA during a grinding mode
FGR=preselected constant, but adjustable, signal representing the desired value of XFRA during another grinding mode
FGRFIN=preselected constant, but adjustable, signal representing the desired value of XFRA during a finish grinding mode
FRT=preselected constant, but adjustable, signal representing the desired value of XFRA during return movement of the wheel to its "parked" position
GT=preselected constant, but adjustable, signal representing gain factor to be applied to SURVERR in deriving VTM
MREF=a one-bit signal indicating whether or not the operator has actuated the "Machine Reference" switch
XRLS=a one-bit signal indicating whether or not the wheel slide is engaging the X-axis reference limit switch XRLS
PTREF=a one-bit signal indicating whether or not the operator has actuated the "Part Reference" switch
RSURA=$S_r$=actual relative surface velocity at truing interface
RSUR1=preselected constant, but adjustable, signal representing a first set point for RSURA
RSUR2=preselected constant, but adjustable, signal representing a second set point for RSURA
SURVERR=difference between RSURA and either RSUR1 or RSUR2

The foregoing acronyms will be used hereinafter with various subscripts, suffixes and prefixes which are conventional and have readily apparent meanings. For example, the subscript i signifies the instantaneous value in the current iteration interval ΔT, the subscript (i−1) signifies the value in the preceding interval ΔT, etc. The suffix "AVG" or "AV" added to any of the acronyms indicates an average value of that quantity, usually an average of ten values for the last ten iteration intervals ΔT, and the suffix "I" indicates an initial value of that particular quantity. The prefix "Σ" added to any of the acronyms indicates a sum of several such values, usually the sum of the ten values measured or computed during the last ten iteraton intervals ΔT.

In carrying out this particular embodiment of the invention, the minicomputer system of FIG. 2 is conditioned by a master program to constitute a plurality of means for performing certain functions and to carry out the method steps which are involved. The minicomputer system is not the only apparatus involved, however, since the resolvers 29 and 58, the tachometers 36, 39 and 61, the gage 40, the ADC converters 106–112, the DAC converters 101–105, and the motors WFM, TFM, PM, WM and TM are all outside the computer system. With this in mind, a detailed understanding of this embodiment of the invention may best be gained from a narrative sequence of the operations which repeatedly recur, the pertinent sub-routines of the master program thereby being explained in detail with reference to the flow charts in FIGS. 5 through 13.

FIG. 5 illustrates a main program which the computer system follows while being interrupted at successive intervals for execution of the subroutines illustrated in FIGS. 6 through 13. For example, the successive time periods ΔT measured off by the clock 70 and the timing signal generator 71 may be 40 milliseconds in duration. Within each such period, sub-periods are marked off by timing pulses so that a sub-routine may be executed during a fraction of every ΔT, although there will almost always be time remaining at the end of each such sub-period during which the system returns to the main program and proceeds therethrough. Thus, each subroutine is executed once during each of the main iteration periods ΔT, e.g., every 40 ms. Computational step pulses typically appear every microseconds, so that 2000 fetch, compute or store steps may be executed during each 40-ms interval. The various servo motors are preferably updated multiple times within each iteration interval ΔT, in accordance with the "micromove-macromove" system described in U.S. Pat. No. 3,656,124. The particular time periods mentioned here are exemplary only, and these periods can be chosen to have other specific values.

Referring now to FIG. 5, there is shown a main program which the system follows whenever power to the grinding machine is turned on. The first step 001 clears all flags in the system, after which step 002 produces a prompting message instructing the operator to enter the desired predetermined values for the various set points and constants required in later steps. This prompting message is typically displayed on the CRT 86 (FIG. 2) located adjacent the manual data input keyboard 87. The particular values that must be entered by the operator are those values contained in the rectangles with the diagonal corner lines in the memory diagram of FIG. 3. These value may be manually keyed into the memory 80, or they may be previously recorded on a tape and entered via the tape reader 77.

At step 003, the system produces another prompting message which instructs the operator to load a workpiece of known radius and to keyed-in the value KNORAD of that known radius. This workpiece of known radius is normally a "master" part which has been previously ground to a smooth surface finish, and whose radius has been precisely measured with a micrometer. As will be seen from the ensuing description, the use of such a "master" part is desirable because it permits the starting position of the grinding wheel to be known with a high degree of precision, and it also permits the starting radius of the grinding wheel to be accurately computed in those applications where it is necessary or desirable to know the wheel radius. Alternatively, for applications where such a high degree of precision is not required, the workpiece that is initially loaded into the machine may be the actual workpiece to be ground; although such a workpiece will have a rougher surface than a "master" part, and its starting radius will not be ascertainable with the same degree of precision as a "master" part, the degree of accuracy attainable by starting with such a rough part may be acceptable in a large number of applications.

At step 004, the system displays still another prompting message which instructs the operator to start the drive motors PM, WM and TM which rotate the workpiece, the grinding wheel, and the truing roll, respectively. Of course, as soon as these motors PM, WM and TM are started, the subroutines to be described below for controlling the rotational velocities of these motors will immediately take over control of the motors, supplying them with the voltage levels required to achieve and maintain the desired speeds.

At step 005, the system displays yet another prompting message which instructs the operator to "Perform Machine Reference", which the operator initiates by simply closing an "MREF" switch, which is one of the switches 87 indicated generally in FIG. 2 and typically located on the keyboard. This prompting message might be displayed before the operator has completed all the set-up steps indicated by the previous messages at steps 002, 003 and 004, and thus the system sustains the message to "Perform Machine Reference" until step 006 senses the closing of the "MREF" switch. When this switch is closed, the system proceeds to step 007 and sets a "Mode 1" flag MD1 which enables the X-axis subroutine of FIG. 6 to advance the wheel slide at a "jogging" feed rate FJOG whenever the operator closes a "JOG" switch, which is another one of the switches 87 in FIG. 2.

In mode 1, the wheel slide feed motor WFM is energized to move the wheel slide at the rate FJOG whenever the operator closes the "jog" switch, with the direction of movement depending upon whether the operator moves the "jog" switch to the "forward" position (producing a minus FJOG signal which causes the wheel slide to move toward the workpiece) or to the "reverse" position (producing a plus FJOG signal which causes the wheel slide to move away from the workpiece). Energization of the motor WFM to move the wheel slide at this rate, when the "jog" switch is closed, is effected by the X-axis subroutine of FIG. 6. That is, the axis of movement of the wheel slide is referred to herein as the "X-axis".

The X-axis subroutine of FIG. 6 begins at step 101 which samples a disabling flag DISABL. If this flag is off, the subroutine proceeds to step 102 which determines whether or not the mode 1 flag MD1 is on. If it is, the system proceeds to step 103 which determines whether or not the operator has closed the "jog" switch. If the answer is affirmative, the system sets a commanded feed rate XFRA (in inches/minute) equal to the jogging rate FJOG at step 104, and this commanded feed rate XFRA is then used at step 106 to determine the value of $\Delta X_i$, which is the commanded feed rate in inches/ΔT. That is, step 106 merely converts the commanded inches-per-minute signal XFRA to an inches-per-ΔT signal by dividing XFRA by 1500, because there are 1500 40-ms. ΔT's in each minute. In other words, $X_i$ represents the incremental distance through which the wheel slide must be advanced in one iteration interval ΔT of 40 ms in order to achieve the desired feed rate FJOG, which is keyed into the memory in units of inches per minute.

It will be helpful to note at this point that the different wheel slide feed rates required during the different modes of operation illustrated in FIG. 4 are achived by simply changing the value of the commanded feed rate signal XFRA in the X-axis subroutine of FIG. 6. Changing the value of XFRA always results in a corresponding change in the value of $\Delta X_i$, which in turn changes the level of the energizing voltage $V_{wfm}$ supplied to the wheel slide feed motor WFM.

Before the value of $\Delta X_i$ is determined at step 106, the subroutine of FIG. 6 proceeds to step 105, where the resolver signal XR is read. This resolver signal represents the changing position of the output shaft of the motor WFM, and thus the change $\Delta XAP_i$ represented by the difference between each pair of successive readings $XR_i$ and $XR_{i-1}$ of the resolver signal represents the actual change in position of the wheel slide in the iteration interval between the readings $XR_i$ and $XR_{i-1}$. Thus, the signal $XAP_i$ representing the current actual position of the wheel slide can be continually updated by adding each new $\Delta XAP_i$ to the value of the previous position signal $XAP_{i-1}$, which is the second computation carried out at step 106 as illustrated in FIG. 6.

At step 107, the signal $XCP_i$ representing the current commanded position of the wheel slide is similarly updated in each iteration interval by adding the value $\Delta X_i$ to the previous commanded position signal $XCP_{i-1}$, which is the first computation carried out at step 107 as illustrated in FIG. 6. The second computation at step 107 determines the value of an error signal $XERR_i$, which is the difference between the current commanded position signal $XCP_i$ and the current actual position signal $XAP_i$. This error signal $XERR_i$ is then used in the final computation of step 107, which computes the value of the voltage command signal $XVC_i$ to be converted by the DAC converter 101 to the drive voltage $V_{wfm}$ for the wheel slide feed motor WFM. As illustrated in FIG. 6, the value of this command signal $XVC_i$ is the value of the error signal $XERR_i$ multiplied by a keyed-in proportionality or gain factor GX.

When the "jog" switch is not closed—e.g., due to intermittent operation of the switch by the operator—step 103 produces a negative response which causes the system to set XFRA to zero at step 108. As will be appreciated from the foregoing description, the wheel slide feed motor WFM will be de-energized, thus simply holding the wheel slide at a fixed position, as long as XFRA is zero.

It can be noted here that the computations just described as being carried out at steps 105–107 are the same whenever the wheel slide feed motor WFM is energized in any of the modes 1, 3, 5, 6 or 7. The value of $\Delta X_i$ changes depending upon the mode in which the system is operating at any given instant and, as indicated previously, this change in the value of $\Delta X_i$ is effected by simply changing the value of the commanded feed rate signal XFRA.

Returning now to the main program in FIG. 5, after the mode 1 flag MD1 has been set at step 007, the system proceeds to step 008 which displays another prompting message to the operator, this time instructing the operator to "jog until XRLS is closed." It will be recalled that XRLS is the limit switch which establishes the retracted reference position of the wheel slide, and when the wheel slide is in this reference position the distance from the rotational axis of the workpiece to the rotational axis of the grinding wheel is a known value represented by the signal XSO. In response to the prompting message at step 008, the operator proceeds to use the "jog" switch to retract the wheel slide until it closes the limit switch XRLS, which is sensed at step 009 and results in the setting of the flag DISABL at step 010. It is this flag DISABL which is read at step 101 of the X-axis subroutine of FIG. 11, and when this flag is set the system immediately exits the X-axis subroutine at step 108 and returns to the main program. This ensures that the wheel slide feed motor is de-energized when the switch XRLS is closed, even if the operator accidentally keeps the "jog" switch closed.

With the wheel slide now in its retracted reference position, the system proceeds to step 011 which sets the starting values of the actual wheel slide position signal XAP and the commanded wheel slide position signal XCP equal to the keyed-in value MACHREF, and it also sets the value of the initial commanded position signal XCPI equal to the same value. The value of MACHREF represents the distance from the rotational axis of the workpiece to the face of a grinding wheel which has a starting radius of a preselected value, e.g., 12 inches, which is normally selected to be the radius of the largest wheel that might be used in the machine. If the wheel actually has a smaller radius, of course the starting values of XAP and XCP must be adjusted accordingly, in a manner to be described below.

From step 011, the system proceeds to step 012 which clears the flag DISABL, after which another prompting message is displayed at step 013, instructing the operator to "jog wheel to kiss known part". The operator thus proceeds to use the "jog" switch again, this time slowly advancing the grinding wheel until it just lightly engages the workpiece. As can be seen in FIG. 4, this is still part of mode 1, i.e., the flag MD1 is still on, and thus the subroutine of FIG. 6 still sets the commanded feed rate XFRA at the "jogging" rate FJOG, though this value FJOG will now be negative because the operator will be moving the "jog" switch to the "forward" position. During the advancing jogging movement of the wheel slide, the values of XAP and XCP, which were both initially set at the value of MACHREF at step 011, are continually changed at steps 105 and 107; that is, in each $\Delta T$ of jogging movement, XCP is reduced by the value of $\Delta X$, and XAP follows with the same change due to the changing resolver signal XR as the wheel slide is advanced in response to the changes in XCP.

The operator is next instructed to "perform part reference", which is the promting message displayed at step 014. The operator initiates this procedure by simplying closing a "PTREF" switch, which is another one of the switches 87 in FIG. 2. Step 015 of the main program senses when the PTREF switch is closed, maintaining the prompting message at step 014 in the meantime, and clears the flag MD1 when closure of the PTREF switch is detected. This is the end of mode 1.

Immediately after clearing the flag MD1, the system sets the flag DISABL at step 017, and then sets the "mode 2" flag MD2 at step 020. In mode 2, the wheel slide feed motor WFM is disabled while the system (1) adjusts the values of both XCP and XAP to the value of the signal KNORAD representing the known radius KNORAD of the master workpiece and (2) computes the actual value of the initial wheel radius RADW by subtracting (a) the known workpiece radius KNORAD and (b) the distance REFCH traversed by the wheel slide during its advancing movement, from (c) the original distance XSO between the rotational axes of the workpiece and the grinding wheel. As indicated at step 021 in FIG. 5, which is the step at which the mode 2 operations are performed, the value of REFCH is computed as the difference between the final value of XCP at the end of mode 1, when the wheel first engages the workpiece, and the initial value XCPI set at step 011 when the wheel was in its retracted reference position.

The value XSO is one of the keyed-in constants stored in the memory and represents the distance between the rotational axes of the workpiece and the grinding wheel when the grinding wheel is in its retracted reference position set by the closing of the reference limit switch XRLS. This distance XSO is the sum of three dimensions, namely, the known radius KNORAD of the master workpiece, the starting wheel radius RADWI, and the original gap REFCH between the faces of the workpiece and the grinding wheel with the grinding wheel in its retracted reference position. Thus, by subtracting two of these dimensions, namely the original gap REFCH and the known workpiece radius KNORAD, from XSO, the remaining value represents the actual initial radius RADWI of the grinding wheel. Also, it is known at this point that the distance between the grinding wheel face and the rotational axis of the master workpiece is exactly equal to the known radius KNORAD of the master workpiece, and thus the values of the signals XAP and XCP representing the actual and commanded positions of the grinding wheel face should both be exactly the same as the value of KNORAD. Thus, XAP and XCP are both initialized at this value. Finally, a gage reference signal PTRADI is set equal to the known workpiece radius KNORAD being read by the gage at this time.

This is the end of mode 2, which completes the "set up" procedure, and the main program proceeds to step 022 which clears the flag MD2 and again clears the flag DISABL. The system then proceeds to step 023 where a "mode 7" flag MD7 is set. In this mode, which is repeated at the end of the grinding of each workpiece (see FIG. 4), the grinding wheel is retracted from its known position XAP=KNORAD to a predetermined "parked" position so that the operator has enough room to remove the master workpiece and insert the actual workpiece to be ground. This actual workpiece will, of course, usually have a radius slightly different from that of the master workpiece, but the actual position of the face of the grinding wheel relative to the rotational axis of the workpiece is still precisely known because all movements of the wheel from its known starting position XAP=KNORAD are continually measured by monitoring the resolver signals XR and updating the value of the actual position signal XAP.

In order to retract the grinding wheel to the predetermined "parked" position, step 024 of the main program sets a commanded wheel slide "end point" position XCEP for the desired park position which is represented by the keyed-in value RETRP. Retracting movement of the wheel slide is effected by the X-axis subroutine of FIG. 6 which in mode 7 proceeds through steps 101, 102, 109, 110, 111, 112, and finally detects the presence of the flag MD7 at step 113. The subroutine then proceeds to step 114 which sets the commanded feed rate signal XFRA equal to a keyed-in value FRT representing the desired velocity of the wheel slide during retracting movement of the grinding wheel to the "parked" position. As described previously, the value of XFRA determines the actual rate of movement of the wheel slide by determining the value of $\Delta X_i$ at steps 106 and 107.

Step 025 of the main program senses when the grinding wheel has reached the desired "parked" position by detecting when the difference between the set "end point" position XCEP and the current commanded position $XCP_i$ is less than the value of $\Delta X_i$. When the answer at step 025 is affirmative, the system sets the value of the commanded position signal XCP for step 107 of the subroutine of FIG. 6 equal to the value of the "end point" position signal XCEP, which causes the retracting movement of the wheel slide to be terminated at the position represented by XCEP, which is the desired "parked" position represented by the keyed-in value RETRP. The main program then clears the flag MD7 at step 027, thereby ending mode 7, and proceeds to step 028 where another prompting message is displayed for the operator, this time instructing the operator to "turn off part motor and load unground workpiece".

After an appropriate delay, allowing time for the operator to load the actual workpiece to be ground, the system proceeds to step 029 which displays another prompting message, instructing the operator to "start workpiece motor and perform cycle start." The "cycle start" operation by the operator, which initiates the actual grinding of the workpiece, is accomplished by simply closing a "cycle start" switch, which is another one of the switches 87 in FIG. 2. Step 030 of the main program senses when the operator has closed the "cycle start" switch, and then proceeds to set the "mode 3" flag MD3 at step 031. This initiates mode 3, in which the wheel slide is advanced from its "parked" position into "kissing" engagement with the workpiece to initiate grinding.

When the "mode 3" flag MD3 is on, the X-axis subroutine of FIG. 6 produces an affirmative response at step 109 and proceeds to step 115 which sets the commanded feed rate signal XFRA equal to a keyed-in value FGAP representing the rate at which it is desired to advance the grinding wheel into engagement with the workpiece. Here again, setting the commanded feed rate XFRA equal to the desired value automatically determines the wheel slide feed rate by determining the value of $\Delta X_i$ at steps 106 and 107 of the X-axis subroutine.

Steps 031*a* and 032 of the main program senses when the grinding wheel engages the workpiece. This is accomplished by setting the value of an "initial wheel torque" signal TORWI equal to the value of the current signal TORW received from the torque transducer 35 via the ADC 112, at step 031*a*. At this point, of course, the grinding wheel has no load on it, and thus the value of the signal TORW is relatively low. From step 031*a*, the main program advances to step 032 which senses when the actual grinding wheel torque $TORW_i$ exceeds a predetermined multiple, e.g., 1.3, of the initial wheel torque TORWI. When an affirmative response is produced at step 032, it is known that the grinding wheel has been brought into grinding contact with the workpiece, and the main program proceeds to step 033 where mode 3 is terminated by clearing the flag MD3. Mode 4 is then initiated at step 034 where a "mode 4" flag MD4 is set.

The clearing of the flag MD3 and the setting of the flag MD4 causes the X-axis subroutine of FIG. 6 to produce a negative response at step 109 and an affirmative response at step 110 in the next iteration cycle. The affirmative response at step 110 causes the subroutine to proceed to step 116 where the commanded feed rate signal XFRA is set at a keyed-in value GR representing to the desired rought grinding rate. From step 116, the system proceeds through step 117, which will be described below, to step 118 where the current value of the signal $XAP_i$ is computed. Normally, the value of this signal $XAP_i$ represents the actual position of the wheel face, and it is updated in each iteration interval $\Delta T$, by adding the current value of $\Delta XAP_i$ (representing the difference between the latest pair of resolver signals $XR_i$ and $XR_{i-1}$) to the previous value $XAP_{i-1}$. In mode 4, however, the value of $XAP_i$ is modified by adding a further value CORΔ in order to compensate for wheel wear. Although the commanded feed rate signal XFRA is set exactly equal to the value of the desired grind rate GR, this feed rate will not actually produce grinding at the rate GR because unless some allowance is made for wheel wear. This allowance is provided by the factor CORΔ, the value of which is computed in the subroutine of FIG. 7.

Turning now to FIG. 7, this subroutine uses the gage signal GS to continually update the signal $PTRAD_i$ representing the actual workpiece radius, which is not only one of the values needed to compute the value of the wheel wear compensation factor COR used in mode 4, but also is the value used to compute the value of the "distance to go" signal $DTG_i$ in modes 4 and 5. Thus, the subroutine of FIG. 7 is active only during modes 4 through 6, which are the only modes during which grinding is taking place.

The first step 200 of the subroutine of FIG. 7 detects whether any of the flags MD4, MD5 or MD6 is on, and if the answer is negative the system immediately exits from this subroutine. If the answer is "yes" at step 200, the system proceeds to step 201 where the value of the gage signal GS is read from the gage ADC 111. A running average of the gage signal value GS, for the last ΔT's, is continually updated and stored as the value $GS_i$ at step 202, and this value is then used at step 203 to update the actual workpiece radius value $PTRAD_i$ by adding the latest average gage signal value $GS_i$ to the original gage reference value PTRADI.

At step 204 the subroutine tests the flag MD4, and if the answer is negative it means that the system is in mode 5 or 6. Both of these modes 5 and 6 require only the updated workpiece radius value $PTRAD_i$, not the wheel wear compensation factor CORΔ, and thus the system exits from the subroutine of FIG. 7 in response to a negative answer at step 204 and returns the system to the main program at step 206. An affirmative response at step 204 means that the system is in mode 4, and thus the subroutine proceeds to step 205 where the value of the compensation factor CORΔ is computed. More specifically, step 205 first moves an error signal $RADERR_i$ to memory location RADERRI (thereby "saving" that signal), and then computes a new value for the error signal $RADERR_i$ by subtracting the current wheel position $XAP_i$ from the current workpiece radius $PTRAD_i$. Thus, the value of $RADERR_i$ represents the current difference between the actual workpiece radius as represented by $PTRAD_i$ and the current actual wheel face position as represented by $XAP_i$.

The error signal $RADERR_i$ is used to compute conventional "PID" control factors $PFACTOR_i$, $IFACTOR_i$ and $DFACTOR_i$ which, as is well known, represent proportional, integral and derivative control terms which are used to control the wheel slide feed motor WFM in a stable manner. Such "PID" control of servo motors is well known per se and need not be explained in detail herein. As indicated in FIG. 7, the proportional factor $PFACTOR_i$ is computed by multiplying the error signal $RADERR_i$ by a keyed-in gain factor GP; the integral factor $IFACTOR_i$ is computed by multiplying the error signal $RADERR_i$ by a keyed-in integral gain factor GI and adding the resulting product to the previous value $IFACTOR_{i-1}$; and the derivative factor $DFACTOR_i$ is computed by subtracting the previous error signal value RADERRI from the current error signal $RADERR_i$ and multiplying the resulting difference by a keyed-in derivative gain factor GD. The value of $COR\Delta_i$ is then the sum of the three factors $PFACTOR_i$, $IFACTOR_i$, and $DFACTOR_i$.

Returning now to the X-axis subroutine of FIG. 6, it will be noted that the value $COR\Delta_i$ is used at step 117 to continually update the signal $RADW_i$ representing the current actual wheel radius. This value $RADW_i$ is updated by subtracting the current value of $COR\Delta_i$ from the previous value $RADW_{i-1}$ in each iteration interval. Step 117, also computes the value of a signal $DTG_i$ representing the distance to go to the desired final workpiece radius PTRADD. This value $DTG_i$ is the difference between the current value of the signal $PTRAD_i$ representing the actual workpiece radius and the desired final radius value PTRADD.

The final computation performed at step 117 determines the value of a signal $FD_i$ which represents the decelerating rate at which it is desired to feed the grinding wheel into the workpiece during finish grinding. As will be apparent from the ensuing description, this feed rate FD decelerates exponentially with time. As indicated at step 117 in FIG. 6, the value of $FDI_i$ at any given instant is the current value of the "distance to go" signal $DTG_i$ multiplied by the ratio GR/DD1. The ratio GR/DD1 is actually a constant for any given grinding system, because GR is the constant value representing the rate at which it is desired to grind the workpiece in mode 4, and DD1 is the constant value representing the DTG value at which it is desired to initiate simultaneous truing. Since both of these values GR and DD1 are constants, the ratio GR/DD is obviously also a constant. The value of $DTG_i$, however, is constantly decreasing as the grinding operation reduces the workpiece radius closer and closer to the desired final radius PTRADD. Consequently, the value of $FD_i$ will also be constantly reducing, and this reduction occurs at an exponential rate with respect to time. The manner in which this exponentially decreasing feed rate value $FD_i$ is used to control the wheel slide feed rate will be described in more detail below in the description of mode 6.

The net result of the X-axis control system in mode 4 is to advance the wheel slide at a rate equal to the sum of the desired grind rate GR and the wheel wear rate represented by the value of CORΔ. The truing roll has not yet engaged the grinding wheel, because there is no simultaneous truing during mode 4, but it is desired to have the truing roll follow the grinding wheel at a constant gap so that the truing roll can be quickly and smoothly brought into engagement with the grinding wheel when it is desired to initiate simultaneous truing. To accomplish this, the truing roll is initially set at a position which establishes the desired gap between the opposed faces of the truing roll and the grinding wheel, and then the truing slide is advanced at a rate set by the value of CORΔ during mode 4. As can be seen from the timing diagram in FIG. 4, the gap is initially set in mode 7, after which the truing slide remains stationary until its advancing movement at the rate CORΔ is started at the beginning of mode 4. The U-axis subroutine for controlling movement of the truing slide is shown in FIG. 8.

Turning now to FIG. 8, the first step 300 of this subroutine determines whether or not the flag MD3 is on because mode 3 is a convenient time to clear a series of flags in this subroutine. As can be seen in FIG. 4, mode 3 is the last mode before the truing slide feed motor TFM is energized for continuous movement. When the system is in mode 3, the subroutine of FIG. 8 proceeds to step 360 where a series of flags GOK7, GOK4, GOD56, CTG, and DTG are cleared, and then to step 315 to be described below. When the system is not in mode 3, step 300 produces a negative response which causes the subroutine to proceed to step 601 to determine whether or not the system is in mode 7. If the answer is negative, the system proceeds to step 302 to test for mode 4, and a negative response causes the system to move on to step 303 to test for mode 5, and then on to 304 to test for mode 6. It is only in these four modes, namely modes 4, 5, 6 and 7, that the truing slide feed motor is energized.

When the system is in mode 7, step 301 yields an affirmative answer, and the subroutine proceeds to step 305 where a flag GOK7 is read to determine whether the truing slide has reached the end of its desired movement for ths particular mode; this flag will be discussed in more detail below. If the flag GOK7 is clear, the system proceeds to step 306 to test a flag SGFL which is normally clear the first time this subroutine is entered in mode 7. A negative response at step 306 advances the system to step 307 which sets the flag SGFL so that the next two steps 308 and 309 are bypassed for the balance of this particular mode.

Step 308 sets the endpoint UCEP for the truing slide movement in mode 7. More specifically, in order to retract the truing slide to a position where the face of the truing roll is spaced a predetermined distance away from the rear face of the grinding wheel, this endpoint UCEP is set to a value that is equal to the sum of the signal $RADW_i$ representing the current wheel radius, the signal RADT representing the truing roll radius (one of the keyed-in constants), and a signal GAP representing the desired distance between the truing roll and the grinding wheel (another keyed-in constant). Having set the desired endpoint UCEP, the system advances to step 309 which sets the U-axis feed rate command signal UFRA equal to a keyed-in value SGV representing a rate of movement that is fast enough to move the truing slide to the desired position before mode 7 ends. From step 309, the system proceeds to step 310 where a value $\Delta U_i$ is set equal to the command signal UFRA, which is in units of inches per minute, divided by 1500 to convert the UFRA value to inches per $\Delta T$ (still assuming a $\Delta T$ of 40 ms.). It will be recognized that this value $\Delta U_i$ is the U-axis counterpart of the value $\Delta X_i$ already discussed above in connection with the X-axis subroutine. That is, the command signal UFRA is set at different values in different modes, always expressed in inches per minute, and $\Delta U_i$ is simply the commanded value UFRA divided by 1500 to convert the units to inches per $\Delta T$.

Once the value of UFRA has been set at step 309, there is no need to repeat steps 308 and 309 for the balance of this particular mode 7, and that is why the flag SGFL is set at step 307. As a result, in the next iteration interval step 306 produces an affirmative response which causes the system to proceed directly from 306 to step 310.

From step 310, the system proceeds to step 311 to determine when the truing slide is within one $\Delta T$ of the desired endpoint UCEP. This is determined by comparing the absolute value of $\Delta U_i$ with the absolute value of the difference between the desired endpoint UCEP and the current commanded truing slide position $UCP_i$. When the difference between UCEP and $UCP_i$ is less than $\Delta U_i$, step 311 produces an affirmative response which causes the system to proceed to step 312 where the value of $\Delta U_i$ is set to zero and the new commanded position $UCP_i$ of the truing slide is set at the value of the desired endpoint UCEP. This will cause the truing slide feed motor to be advanced only to the desired endpoint UCEP in the current $\Delta T$, thereby stopping the truing slide at the desired endpoint UCEP with the truing roll face spaced the desired distance GAP away from the grinding wheel face.

From step 312, the system advances to step 313, which determines whether or not the flag MD7 is on. An affirmative response advances the system to step 314 which sets the flag GOK7 tested at step 305. The setting of this flag indicates that the truing slide is in its last $\Delta T$ of movement in mode 7. Consequently, if mode 7 continues for one or more iteration intervals, an affirmative answer will still be produced at step 301 because the flag MD7 will still be on, but the setting of the flag GOK7 will produce an affirmative answer at step 305. As a result, the system will proceed directly from step 305 to step 315 which sets $\Delta U_i$ to zero for the balance of this mode.

Before the truing slide moves to within one $\Delta T$ of the endpoint UCEP in mode 7, step 311 produces a negative response which advances the system to step 316. Step 316 reads the U-axis resolver signal UR, which represents the changing position of the output shaft of the motor TFM. Thus, the change $\Delta UAP_i$ represented by the difference between each pair of successive readings $UR_i$ and $UR_{i-1}$ of the resolver signal represents the actual change in position of the truing slide in the iteration interval between the readings $UR_i$ and $UR_{i-1}$. The value $\Delta UAP_i$ is used to continually update the signal $UAP_i$ representing the current actual position of the truing slide, by adding each new $\Delta UAP_i$ to the value of the previous position signal $UAP_{i-1}$, which is the second computation carried out at step 316 as illustrated in FIG. 8. The signal $UCP_i$ representing the current commanded position of the truing slide is similarly updated in each iteration interval by adding the value $\Delta U_i$ to the previous commanded position signal $UCP_{i-1}$, which is the third computation carried out at step 316 in FIG. 8. The fourth computation determines the value of an error signal $UERR_i$, which is the difference between the current commanded position signal $UCP_i$ and the current actual position signal $UAP_i$. This error signal $UERR_i$ is then used in the final computation of step 316, which computes the value of the voltage command signal $UVC_i$ to be converted by the DAC converter 102 to the drive voltage $V_{tfm}$ for the truing slide feed motor TFM. As illustrated in FIG. 8, the value of this command signal $UVC_i$ is the value of the error signal $UERR_i$ multiplied by a keyed-in proportionality or gain factor GU.

As in the case of the X-axis subroutine described previously, the computations just described as being carried out at step 316 are the same whenever the truing slide feed motor TFM is energized in any of the modes 4, 5, 6 or 7. The value of $\Delta U_i$ changes depending upon the mode in which the system is operating at any given time, and in most cases a desired change in the value of $\Delta U_i$ is effected by simply changing the value of the commanded feed rate signal UFRA.

In mode 4, the U-axis subroutine of FIG. 8 controls the truing slide motor TFM to advance the truing slide at a rate which maintains the constant distance GAP between the truing roll face and the rear face of the grinding wheel. This constant "following gap" is maintained until it is desired to start closing the gap in order to initiate simultaneous truing and grinding. In this particular example, a preselected, keyed-in "distance to go" value DD1 (see FIG. 4) is used as an indication of when it is desired to initiate simultaneous truing and grinding, and the advancing movement of the truing slide is accelerated to close the "following gap" 100 ΔT's before the "distance to go" signal $DTG_i$ reaches the keyed-in value DD1. It will be recalled that the signal $DTG_i$ is continually updated during mode 4 at step 117 of the X-axis subroutine of FIG. 6. Step 035 of the main program continually compares the current value $DTG_i$ with the sum of the keyed-in value DD1 plus the value 100 $\Delta X_i$; since $\Delta X_i$ remains relatively constant during mode 4, the value 100 $\Delta X_i$ represents the distance that will be traversed by the wheel slide in 100 ΔT's, which means that the sum (DD1+100 $\Delta X_i$) represents the wheel slide position 100 ΔT's before the wheel slide reaches the position at which the distance to go to the desired final radius PTRADD is equal to the value DD1. When the signal $DTG_i$ reaches this value (DD1+100 $\Delta X_i$), step 035 of the main program produces an affirmative response and advances the system to step 036, where a flag CTG is set. This flag CTG is then read in the mode 4 channel of the U-axis subroutine of FIG. 8.

Returning to the beginning of the U-axis subroutine, when the system is in mode 4 negative responses are produced at both steps 300 and 301, and an affirmative response is produced at step 302. This causes the system to proceed to step 320 which reads a flag GOK4, which will be described below. If an affirmative response is produced at step 320, the system is advanced directly to step 314 which sets the value of $\Delta U_i$ to zero, de-energizing the motor TFM. A negative response at step 320 advances the system to step 321 to read the flag CTG, which is the flag set by the main program at the point where it is desired to accelerate the advancing movement of the truing slide to close the "following gap". A negative response at step 321 advances the system to step 322 where the value of $\Delta U_i$ is set equal to the value of CORΔ.

It will be recalled that CORΔ is the value used to adjust the feed rate of the wheel slide to compensate for wheel wear. It will also be recognized that as long it is desired to simply have the truing roll follow the grinding wheel at a constant distance GAP, the truing slide should be advanced at exactly the same rate at which the grinding wheel is wearing, which in units of inches per ΔT is represented by the value CORΔ. Consequently, setting $\Delta U_i$ equal to CORΔ will cause the truing roll to continue following the grinding wheel at a constant distance GAP.

When the flag CTG is set, step 321 produces an affirmative response which causes the system to proceed to step 325 where a new desired endpoint UCEP is set equal to the sum of the current wheel radius value $RADW_i$ and the truing roll radius value RADT. In other words, this endpoint represents the truing slide position where the face of the truing roll just comes into contact with the face of the grinding wheel, which is where UCP equals the sum of RADW and RADT. The next step 326 sets the U-axis feed rate command signal UFRA equal to a new value which is the sum of a preselected, keyed-in constant value CV and a term which is 1500 times the value of CORΔ. The latter term, 1500 CORΔ, is simply the wheel wear rate factor CORΔ converted from inches per ΔT to inches per minute, and the value CV represents a preselected rate (in inches per minute) at which it is desired to close the gap between the truing roll and the grinding wheel.

While the truing roll is being advanced toward the grinding wheel at the closing velocity CV, step 311 is constantly comparing the value of $\Delta U_i$ with the remaining distance between the current commanded truing roll position $UCP_i$ and the desired endpoint UCEP, to detect when the truing roll is within one ΔT of the desired endpoint UCEP. When step 311 produces an affirmative response, the system once again proceeds to step 312 which sets $\Delta U_i$ to zero and sets the new commanded position $UCP_i$ for the truing roll equal to the desired endpoint UCEP. Step 313 then tests the flag MD7, which will produce a negative response in mode 4 and advance the system to step 327. The flag MD4 is always set in mode 4, and thus produces an affirmative response at step 327. Arrival of the truing roll at the endpoint UCEP set at step 325, which is the point at which the truing roll will first contact the grinding wheel, is the event that should terminate advancing movement of the truing slide at the accelerated rate set at step 326. This is accomplished by setting the flag GOK4 at step 328, thereby causing the system to proceed directly from step 320 to step 314 in the next interation interval (if the flag MD4 remains on). It will be understood that the truing slide feed motor TFM will remain energized at the UFRA value set at step 326 for whatever fraction of the last ΔT is required to bring the truing roll to the desired endpoint UCEP, but then the motor TFM will not be driven any further via the mode 4 channel in the U-axis subroutine.

During the period when the gap between the truing roll and the grinding wheel is being eliminated, the values of the exponent b and the coefficient k are also computed. These computations are carried out as part of the main program, at step 036*a* following the setting of the flag CTG 036. The value of the exponent b is computed from the values CORΔ and GR used in the X-axis subroutine during mode 4. These values are used in Equation (11) described above, as rewritten at step 036A, to compute the value of the exponent b, and then the value of the coefficient k is computed from b, using Equation (12) described above, again as rewritten at step 036A. It will be noted that the value CORΔ used in these Equations is multiplied by 1500 to convert the units from inches/ΔT to inches/minute.

It will be recalled that the decelerating feed rate $FD_i$ is continually computed, as a function of the decreasing "distance to go" value $DTG_i$, throughout mode 4 of the X-axis subroutine (FIG. 6). The value of $FD_i$ continuously decreases at an exponential rate, and step 037 of the main program determines when the value of $FD_i$ has been reduced to the value GR representing the desired grinding rate during mode 4. An affirmative response at step 037 is used to clear the flag MD4 at step 038 and to set the "mode 5" flag MD5 at step 039. Mode 4 is thus terminated, and mode 5 is started.

In mode 5, the X-axis subroutine of FIG. 6 produces an affirmative response at step 111, which advances the system to step 119 which continues the same computation of $DTG_i$ and $FD_i$ which were carried out at step 117 in the mode 4 channel. From step 119, the system proceeds to step 120 to read a flag OTG which is set by the U-axis subroutine when simultaneous truing is terminated. A negative response at step 120 causes the system to proceed to step 121 where the value of the commanded feed rate signal XFRA is set to a new value ($FD_i$+WWRT). This new feed rate value is intended to carry out finish grinding by advancing the wheel into the workpiece at the decelerating feed rate $FD_i$ while at the same time advancing the wheel slide at the additional rate WWRT at which the wheel radius is being reduced at the truing interface due to simultaneous truing and grinding. It will be appreciated that the accuracy with which the desired grinding feed rate $FD_i$ is met will be dependent upon the accuracy with which the desired truing rate WWRT is met at the truing interface.

From step 121 the system proceeds through step 105 (described previously) to step 106 where the new value of the commanded feed rate signal XFRA is used to compute the new value of $X_i$. The new value of $\Delta X_i$ is then used at step 107 to control the feed rate of the wheel slide in the same manner described previously.

The mode 5 channel of the U-axis subroutine of FIG. 8 is entered with an affirmative response at step 303, because of the setting of the flag MD5. This subroutine then proceeds to step 330 which reads a flag GOK56 to be described below. If the answer at step 330 is "no", the system advances to step 331 which determines when the "distance to go" value $DTG_i$ is reduced to a keyed-in value TDIS representing the point at which it is desired to terminate simultaneous truing and grinding (see FIG. 4).

As long as step 331 produces a negative response, the U-axis subroutine advances to step 337 where the wheel wear rate WWRG due to grinding is computed for the current value of the grinding feed rate $FD_i$. This value WWRG is computed using Equation (16) as rewritten at step 337, using the values of b and k coputed at step 323 of the subroutine of FIG. 8. The computed value of WWRG is then used at step 338 to compute a new value for the truing slide feed rate command signal UFRA (in units of inches per minute) that will achieve the desired truing rate represented by the value WWRT (one of the keyed-in values) while the wheel is being worn down due to grinding at the computed rate WWRG. As indicated at step 338 in FIG. 8, this new value of the commanded signal UFRA is equal to the sum of WWRT and WWRG. The system then proceeds to step 339 where the new value of $\Delta U_i$ is once again determined by dividing the new FRA value by 1500. As before, this value of $\Delta U_i$ is used at step 316 to control the feed rate of the truing slide.

When step 331 produces an affirmative response, the system advances to step 332 where a flag OTG is read. This flag OTG will always be clear the first time step 332 is reached in each grinding operation, thereby producing a negative response which advances the system to step 333 where the flag OTG is set. The system then proceeds to step 334 where another new end point value UCEP is set. This time UCEP is set at a value equal to the sum of the current wheel radius value $RADW_i$, the truing roll radius value RADT, and the value GAP described previously. This is the same formula followed for the setting of the UCEP value at step 308, but the value determined at step 334 will be somewhat smaller because the wheel radius will have been reduced in the meantime. However, the end result of the new value set at step 334 will be the same as the value set at step 308, i.e., the truing slide will be retracted to a position where the truing roll face is spaced away from the grinding wheel face by a distance corresponding to the value GAP.

From step 334 the system advances to step 335 where the feed rate command signal UFRA is set at the same value CV (but with the opposite polarity) that was used to close the "following gap" in mode 4. This value CV determines the rate at which the truing roll is backed away from the grinding wheel at the point where simultaneous truing and grinding is terminated, which is determined by the value TDIS used at step 331. From step 335, the system proceeds to step 310, where the value of $\Delta U_i$ is once again determined by dividing the new feed rate command signal value UFRA by 1500.

While the truing roll is being retracted at the commanded rate, step 311 constantly compares the absolute value of $\Delta U_i$ with the remaining distance between the newly set endpoint UCEP and the current commanded position $UCP_i$, to determine when the truing roll is within one $\Delta T$ of the desired endpoint. When an affirmative response is produced at step 311, the system proceeds to step 312 (described previously), and steps 313 and 327, both of which produce negative responses. From step 327, the system advances to step 342 which sets the flag GOK6 to indicate that the retracting movement of the truing slide is in its final $\Delta T$. Thus, if the system is still in mode 5 in the next $\Delta T$, it will proceed directly from step 330 to step 315 which sets $\Delta U_i$ to zero so that the truing slide is not driven any farther.

Returning now to the mode 5 channel of the X-axis subroutine of FIG. 6, it will be recalled that the flag OTG is set at step 332 when simultaneous truing and grinding is terminated. When this occurs, it is no longer necessary or desirable to supplement the wheel slide feed rate command value $FD_i$ with the truing rate value WWRT, because truing is no longer being carried out. Accordingly, step 120 of the X-axis subroutine produces an affirmative response when the flag OTG is on, causing the system to proceed to step 122 rather than step 120, and setting the wheel slide feed rate command signal XFRA at the decelerating feed rate value $FD_i$. This will cause finish grinding to continue at the desired wheel feed rate $FD_i$, as indicated in the bottom portion of FIG. 4.

Mode 5 is terminated, and mode 6 initiated, when the decelerating wheel slide feed rate $FD_i$ reaches a keyed-in value FGRFIN representing a desired finish grinding feed rate for the final increment of finish grinding which reduces the workpiece radius to the desired final value PTRADD. Step 042 of the main program determines when the value of $FD_i$ has been reduced to the keyed-in value FGRFIN, and when this condition occurs step 042 produces an affirmative response which advances the system to step 043 to clear the flag MD5, and then on to step 044 which sets the flag MD6.

In the X-axis subroutine of FIG. 6, the setting of the "mode 6" flag MD6 advances the system from step 112 to step 123 where the feed rate command signal XFRA is set to the keyed-in value FGRFIN. From step 123, the system proceeds on through the previously described steps 105 through 108.

In the U-axis subroutine, the setting of the "mode 6" flag produces an affirmative response at step 304, advancing the system to step 350 where the flag GOK56 is read. It will be recalled that this flag GOK56 is the flag that is set when the truing slide had been returned to its retracted position, which can occur in either mode 5 or mode 6. If the truing slide has not yet reached the retracted position, or has not yet even started its retracting movement, step 350 produces a negative response which advances the system to step 332. That is a negative response at step 350 has the same effect as a positive response at step 331—simultaneous truing is terminated by setting UFRA to −CV, and a new end point UCEP is set at step 335. This is the desired result because if mode 6 is entered before the truing slide has even reached the position represented by the value TDIS, it is desired to end simultaneous truing and grinding immediately.

An affirmative response at step 350 indicates that the truing slide has already reached its retracted position, and the system is advanced directly to step 315 which sets the value of $\Delta U_i$ to zero, thereby de-energizing the truing slide feed motor TFM.

During the finish grinding mode 6, the subroutine of FIG. 7 continues to update the actual workpiece radius value $PTRAD_i$ by subtracting the gage signal value $GS_i$ from the original gage reference value PTRADI. This workpiece radius value $PTRAD_i$ is used to determine when finish grinding should be terminated, by determining when the actual workpiece radius value $PTRAD_i$ has been reduced to the desired final workpiece radius value PTRADD. This comparison is carried out at step 045 of the main program, and when this step produces an affirmative answer, the flag MD6 is immediately cleared at step 046. The main program then proceeds to step 047 which clears a flag STEINC (yet to be discussed) and then on to step 048 which returns to step 023 where the flag MD7 is set. This causes the wheel slide drive motor WFM to retract the grinding wheel to its "parked" position in the same manner described previously.

Although the truing roll drive motor TM was started at step 004 of the main program, control of the truing roll speed is not initiated until mode 5, because it is only during mode 5 that the truing roll engages the grinding wheel. The subroutine for controlling the truing roll speed during mode 5 is shown in FIG. 9. This subroutine does not hold the truing roll speed TRV at a set point speed, but rather adjusts the truing roll speed to hold a signal RSURV, representing the relative surface velocity at the truing interface, equal to a set point value RSURA. The value RSURV is computed from an equation is described in more detail in co-pending U.S. patent application Ser. No. 249,192, filed Mar. 30, 1981 for "Grinding Control Methods and Apparatus". That equation is rewritten at step 508 of FIG. 8. As described in the co-pending application, controlling the relative surface velocity at the truing interface is an indirect method of controlling STE.

The first step 500 of the subroutine of FIG. 9 determines whether the flag MD5 is on, and if the answer is affirmative the system proceeds to step 501 which reads the current truing roll speed signal $TRV_i$ from the truing roll tachometer 61. Step 502 computes and stores a running average $TRVAV_i$ of the last ten speed readings $TRV_i$. Similarly, step 503, reads the grinding wheel velocity $WHV_i$ from the wheel tachometer 36, and step 504 computes and stores a running average $WHVAV_i$ of the last ten truing roll speed readings $WHV_i$.

Step 505 reads a flag STEINC which is set at step 041 of the main program when the finish grinding carried out during mode 4 has proceeded to a point where the "distance to go" value $DTG_i$ is equal to a keyed-in value DD2. The value DD2 represents a "distance to go" value at which it is desired to change the STE in order to change the surface condition of the grinding wheel so that a desired surface finish is produced on the workpiece during the last portion of the finish grinding. When the value of $DTG_i$ reaches the value DD2, step 040 of the main program produces an affirmative response which advances the system to step 041 where the flag STEINC is set.

Returning to the subroutine of FIG. 9, up until the time the flag STEINC is set, step 505 produces a negative response which advances the system to step 506 where the value of RSURA is set to a keyed-in set point value RSUR1. The system then proceeds to step 508 where the value RSURV is computed using the equation mentioned above. It will be recognized that this equation, as written at step 508 in FIG. 9, requires a series of separate computations each of which is a straightforward addition, subtraction, multiplication, or division operation. The resulting computed value RSURV is then used at step 509 to compute an error signal SURVERR, which is the difference (if any) between the value RSURA set at 506 and the value RSURV computed at step 508. The error signal SURVERR is then used at step 510 to make an integrating correction to the truing roll speed command signal VTM. More particularly, the error signal SURVERR is multiplied by a gain factor GT, and the resulting product is added to the previous speed command signal $VTM_{i-1}$ to produce a new speed command signal $VTM_i$. The subroutine then returns the system to the main program at step 511.

After the flag STEINC is set at step 401 of the main program, step 505 of the subroutine of FIG. 9 produces an affirmative response which advances the system to step 507 rather than 506, setting the value of RSURA to a second keyed-in set point value RSUR2. This set point RSUR2 is greater than the first set point RSUR1 so as to produce a higher STE, which has the effect of dulling the surface of the grinding wheel so as to produce a smoother final surface finish on the ground workpiece.

A subroutine for periodically re-referencing the values of XAP, XCP, and RADW during modes 5 and 6 is illustrated in FIG. 10. This subroutine is entered at step 800, which determines whether either of the flags MD5 or MD6 is on. If the answer is "no", the system is not in either mode 5 or mode 6, and thus it is returned to the main program at step 802. If either of the flags MD5 or MD6 is on, step 800 produces an affirmative response which advances the subroutine to step 801 to perform the series of operations illustrated in FIG. 10. The first operation at step 801 sets the value of a signal XAPI equal to the current value of the actual position signal $XAP_i$, and the second operation re-references the value of XAP to a new value $XAP_{new}$ equal to the current actual workpiece radius value $PTRAD_i$. The latter operation ensures that the value of the wheel position signal XAP corresponds to the actual workpiece radius value as determined from the gage signal. The rationale for this re-referencing is that the actual workpiece radius as determined from the gage signal should be the most accurate indicator of where the wheel face is actually positioned at any given instant.

After re-refering XAP, step 801 proceeds to compute a re-referencing value REFCH by computing the difference (if any) between $XAP_{new}$ and XAPI. The resulting value REFCH is then used to re-reference both XCP and RADW. More specifically, as indicated at step 801, a new value for XCP is computed as the sum of $XCP_i$ and REFCH, and a new value for RADW is computed by subtracting REFCH from the current value $RADW_i$. This re-referencing subroutine is iterated at timed intervals of, e.g., 0.5 second.

It will be recalled that the workpiece drive motor PM and the grinding wheel drive motor WM were also started at step 004 of the main program. The subroutines for producing the command signals VPM and VWM for controlling the driving voltages $V_{pm}$ and $V_{wm}$ for the two motors PM and WM are illustrated in FIGS. 11 and 12, respectively. Turning first to FIG. 11, which is the subroutine for controlling the workpiece drive motor PM, the first step 600 of this subroutine reads the value of the signal PTV which is the digital counterpart of the analog signal $\omega_p$ received from the workpiece tachometer 39 via the ADC 108. This signal PTV represents the actual speed of the workpiece at any given instant. Step 601 computes and stores a running average PTVAVG of the speed signal PTV over, for example, the last ten ΔT's. This is a conventional averaging technique well known to those skilled in the art, and can be performed, for example, by a "stacking" procedure which continuously stores the latest 10 readings, adding the new value $PTV_i$ and discarding the oldest value $PTV_{i-10}$ in each ΔT. The ten values stored at any given time are summed and divided by ten to provide the desired average value PTVAVG. This averaging procedure is used simply to enhance the reliability of the value of PTVAVG by using a running average of the last ten signal values rather than relying on the single value of only the latest signal.

At step 602, the subroutine of FIG. 11 computes an error signal $PTVERR_i$ as the difference (if any) between the keyed-in set point speed value PTVD (in rpm) and the latest average value $PTVAVG_i$. This error signal $PTVERR_i$ is then used to effect any adjustment required in the command signal VPM which controls the driving voltage $V_{pm}$ supplied to the drive motor PM. More specifically, the error signal $PTVERR_i$ is used to make an integrating correction by multiplying it by a proportionality or gain factor GPV (one of the keyed-in constants), and then adding the resulting product to the value of the command signal $VPM_{i-1}$ for the previous ΔT. The resulting new value $VPM_i$ of the command signal will tend to restore the actual workpiece speed PTV to the set point speed PTVD. The command signal will remain at this new value, holding the actual workpiece speed at the set point speed, unless and until there is a further deviation of the actual speed from the set point speed. Step 603 of this subroutine returns the system to the main program.

The "VWM" subroutine of FIG. 12, for controlling the grinding wheel drive motor WM, is similar to the subroutine of FIG. 11 which has just been described. Thus, the first step 700 of the VWM subroutine reads the value of the actual wheel speed signal WHV from the tachometer 36 and the ADC 109. A running average WHVAVG of the actual speed signal WHV is computed and stored at step 701 and used at step 702 to compute an error signal $WHVERR_i$. This error signal is the difference between the keyed-in set point speed value WHVD (in rpm) and the current average value $WHVAVG_i$, and is used to effect any adjustment required in the command signal VWM to hold the actual wheel speed at the set point speed. More particularly, the error signal $WHVERR_i$ is multiplied by a keyed-in gain factor GWV, and the resulting product is added to the previous value $VWM_{i-1}$ of the command signal to produce a new command signal value $VWM_i$. The final step 703 returns the system to the main program.

In the foregoing example, the values of the exponent b and the coefficient k are computed during the rough grinding of each separate workpiece, just before the finish grinding is initiated. As an alternative, particularly in applications where such a high degree of precision is not an absolute requirement, the values of b and k can be approximated from computations performed in other, preferably similar, grinding operations. Many grinding operations are highly repetitious, using grinding wheels with the same material and the same initial size to grind the same kind of workpiece day after day. Consequently, once the values of b and k have been determined for the grinding of one such workpiece with one such grinding wheel in a given set of grinding conditions, those values of b and k will normally have a high degree of validity for other, similar grinding operations. For example, it has been found that the use of value "2" for the exponent b and the value "1" for the coefficient k will produce satisfactory results in many grinding operations. These particular values can be used in the system that has been described in detail above by simply omitting step 036a of the main program and using keyed-in values of "2" and "1" for b and k, respectively, at step 337 of the U-axis subroutine of FIG. 8.

It should also be noted that the system described above is based upon an assumption that the truing roll wear is insignificant enough that it can be ignored, i.e., the value RADT is assumed to be a constant. If desired, however, the system can be refined to compensate for the wear rate of the truing roll, which is normally much smaller than the wear rate of the grinding wheel. Examples of specific systems for compensating for the truing roll wear rate are described in the aforementioned copending application Serial No. 249,192, which is assigned to the assignee of the present invention.

While the invention in its various aspects has been shown and described in some detail with reference to different specific embodiments, there is no intention thereby to limit the invention to such detail. On the contrary, it is intended to cover all alternatives, variations and equivalents which fall within the spirit and scope of the following claims.

We claim as our invention:

1. A method of finish grinding a selected workpiece with a selected grinding wheel while simultaneously truing the grinding wheel with a selected truing element, said method comprising determining the relationship between the wear rate of said grinding wheel and the feed rate at which said grinding wheel is fed into said workpiece, feeding said grinding wheel into said workpiece at a grinding feed rate which decreases as the desired final radius of the workpiece is approached, and simultaneously feeding said truing element into said grinding wheel at a rate which varies in accordance with said relationship between the wear rate of said grinding wheel due to grinding and the decreasing feed rate at which said wheel is fed into said workpiece.

2. A finish grinding method as set forth in claim 1 wherein said truing element is advanced toward said grinding wheel at a rate which has (1) a first component corresponding to the rate at which it is desired to remove material from the grinding wheel at the truing interface and (2) a second component corresponding to the wear rate of said grinding wheel due to grinding at said grinding feed rate, said second component varying in accordance with said relationship between the wear rate and the feed rate of said grinding wheel.

3. A finish grinding method as set forth in claim 2 wherein said grinding wheel is advanced toward said workpiece at a rate which has (1) a first component corresponding to said grinding feed rate and (2) a second component corresponding to the rate at which material is removed from the grinding wheel at the truing interface.

4. A finish grinding method as set forth in claim 1 wherein said grinding feed rate decreases as an exponential function of time.

5. A finish grinding method as set forth in claim 1 wherein said grinding feed rate decreases as a function of the remaining distance between the wheel face and the desired final radius to said workpiece.

6. A finish grinding method as set forth in claim 1 wherein said relationship between the wheel wear rate $R'_{wg}$ due to grinding and the grinding feed rate $F_w$ is defined by the expression $$R'_{wg}=kF_w^b$$

wherein the values of k and b are substantially constant for the grinding of at least one workpiece.

7. A method of finish grinding a selected workpiece with a selected grinding wheel, said method comprising finish grinding said workpiece while monitoring the actual radius of said workpiece as the grinding thereof progresses, feeding said grinding wheel into said workpiece at a feed rate which decreases as a function of the remaining difference between the actual radius of the workpiece and the desired final radius of the workpiece, and terminating the feeding of said grinding wheel at a desired final radius of said workpiece.

8. A finish grinding method as set forth in claim 7 wherein said grinding wheel is trued at the same time it is grinding, by feeding a truing element into said grinding wheel, said truing element being advanced at a rate that varies as a function of the rate at which said grinding wheel is fed into said workpiece.

9. A finish grinding method as set forth in claim 8 wherein said truing element is advanced toward said grinding wheel at a rate which has (1) a first component corresponding to the rate at which it is desired to remove material from the grinding wheel at the truing interface and (2) a second component corresponding to the wear rate of said grinding wheel due to grinding at the interface grinding, said second component varying as a function of the rate at which said grinding wheel is fed into said workpiece.

10. A finish grinding method as set forth in claim 8 wherein said grinding wheel is advanced toward said workpiece at a rate which has (1) a first component corresponding to the rate at which it is desired to feed said grinding wheel into said workpiece and (2) a second component corresponding to the rate at which material is removed from the grinding wheel at the truing interface.

11. A finish grinding method as set forth in claim 7 wherein said feed rate of said grinding wheel decreases as an exponential function of time.

12. A finish grinding method as set forth in claim 7 wherein said feed rate of said grinding wheel decreases as a function of the remaining distance between the wheel face and the desired final radius of said workpiece.

13. A finish grinding method as set forth in claim 8 wherein said second component varies according to the function defined by the expression $$R'_{wg}=kF_w^b$$

wherein $R'_{wg}$ is the wheel rate due to grinding, $F_w$ is the rate at which the grinding wheel is fed into the workpiece, and the values of k and b are substantially constant for the grinding of at least one workpiece.

14. Apparatus for finish grinding a selected workpiece with a selected grinding wheel while simultaneously truing the grinding wheel with a selected truing element, said apparatus comprising means for determining the relationship between the wear rate of said grinding wheel and the feed rate at which said grinding wheel is fed into said workpiece, means for feeding said grinding wheel into said workpiece at a grinding feed rate which decreases as the desired final radius of the workpiece is approached, and means for simultaneously feeding said truing element into said grinding wheel at a rate which varies in accordance with said relationship between the wear rate of said grinding wheel due to grinding and the decreasing feed rate at which said wheel is fed into said workpiece.

15. Finish grinding apparatus as set forth in claim 14 which includes means for advancing said truing element toward said grinding wheel at a rate which has (1) a first component corresponding to the rate at which it is desired to remove material from the grinding wheel at the truing interface and (2) a second component corresponding to the wear rate of said grinding wheel due to grinding at said grinding feed rate, said second component varying in accordance with said relationship between the wear rate and the feed rate of said grinding wheel.

16. Finish grinding apparatus as set forth in claim 15 which includes means for advancing said grinding wheel toward said workpiece at a rate which has (1) a first component corresponding to said grinding feed rate and (2) a second component corresponding to the rate at which material is removed from the grinding wheel at the truing interface.

17. Finish grinding apparatus as set forth in claim 14 which includes means for decreasing said grinding feed rate as an exponential function of time.

18. Finish grinding apparatus as set forth in claim 14 which includes means for decreasing said grinding feed rate as a function of the remaining distance between the wheel face and the desired final radius of said workpiece.

19. Finish grinding method as set forth in claim 14 wherein said relationship between the wheel wear rate $R'_{wg}$ due to grinding and the grinding feed rate $F_w$ is defined by the expression $$R'_{wg}=kF_w^b$$

wherein the values of k and b are substantially constant for the grinding of at least one workpiece.

20. A finish grinding method as set forth in claim 1 which includes the step of controlling the specific truing energy STE as the desired final radius of the workpiece is approached, to produce the desired final surface finish on the workpiece.

21. A finish grinding method as set forth in claim 8 wherein the rate at which said grinding wheel is advanced toward said workpiece, and the rate at which said truing element is advanced toward said grinding wheel, are both varied as a function of the wear rate of said grinding wheel due to grinding at the grinding interface.

22. A finish grinding method as set forth in claim 21 wherein said wheel wear rate is determined from the relationship $$R'_{wg}=kF_w^b$$

where $R'_{wg}$ is the wheel wear rate due to grinding, $F_w$ is the rate at which the grinding wheel is fed into the workpiece, and the values of k and b are constants for the grinding of at least one workpiece.

23. A finish grinding method as set forth in claim 22 wherein said wheel wear rate is computed from the equation $$R'_{wg}=\text{antilog}\ [k+(b \log F_w)]$$

24. A method of finish grinding a selected workpiece with a selected grinding wheel while simultaneously truing the grinding wheel with a selected truing element, said method comprising controllably feeding said grinding wheel into said workpiece at a desired grinding feed rate, repetitively reducing said desired grinding feed rate as a function of the remaining difference between the actual workpiece radius and the desired final workpiece radius, repetitively determining the rate of wear of said grinding wheel at the grinding interface, simultaneously with the feeding of said grinding wheel into said workpiece, controllably feeding said truing element into said grinding wheel at a desired feed rate, and repetitively adjusting the rate of advancement of said ftruing element toward said grinding wheel as a function of the rate of wear of said grinding wheel at the grinding interface.

25. A finish grinding method as set forth in claim 24 wherein said rate of wear of the grinding wheel at the grinding interface is determined from the grinding wheel feed rate and a predetermined relationship between that feed rate and the wheel wear rate.

26. A finish grinding method as set forth in claim 25 wherein said predetermined relationship between the grinding wheel feed rate $F_w$ and the wheel wear rate $R'_{wg}$ at the grinding interface is defined by the expression $$R'_{wg}=kF_w^b$$

where k and b are predetermined constants.

27. A finish grinding method as set forth in claim 26 which includes the steps of measuring the actual grinding rate and the actual feeding displacement of the grinding wheel face, determining the actual wheel wear rate as the difference between said actual grinding rate and said actual feeding displacement, and computing the values of the coefficient k and the exponent b in the equation $$R'_w=kF_w^b$$

from said actual wheel wear rate and the actual wheel feed rate.

28. A method of finish grinding a workpiece with a selected grinding wheel while simultaneously truing the grinding wheel with a selected truing element, said method comprising determining the relationship between the wear rate $R'_{wg}$ of said grinding wheel and th4e feed rate $F_w$ at which said grinding wheel is fed into said workpiece, grinding said workpiece with said grinding wheel while simultaneously truing the grinding wheel with said truing element, repetitively reducing said desired grinding feed rate as a function of the remaining difference between the actual workpiece radius and the desired final workpiece radius, determining the wheel wear rate $R'_{wg}$ (at the grinding interface) corresponding to each grinding feed rate $F_w$ from the previously determined relationship between $R'_{wg}$ and $F_w$, simultaneously with the feeding of said grinding wheel into said workpiece, controllably feeding said truing element into said grinding wheel at a desired feed rate, advancing the grinding wheel toward the workpiece at a controlled rate $F_{ws}$ which is approximately equal to the sum of the grinding feed rate $F_w$ and the rate $R'_{wt}$ of reduction in the wheel radius at the truing interface, and repetitively adjusting the rate of advancement of said truing element toward said grinding wheel as a function of the rate of wear of said grinding wheel at the grinding interface.

* * * * *